US006494556B1

(12) United States Patent
Sayama et al.

(10) Patent No.: US 6,494,556 B1
(45) Date of Patent: Dec. 17, 2002

(54) LIQUID JETTING APPARATUS, METHOD OF DRIVING THE SAME, AND COMPUTER-READABLE RECORD MEDIUM STORING THE METHOD

(75) Inventors: Tomohiro Sayama; Junhua Chang, both of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 55 days.

(21) Appl. No.: 09/640,643

(22) Filed: Aug. 18, 2000

(30) Foreign Application Priority Data

Aug. 18, 1999 (JP) ..... 11-231739
Jul. 10, 2000 (JP) ..... 2000-208631

(51) Int. Cl.[7] ..... B41J 29/38
(52) U.S. Cl. ..... 347/11; 347/9; 347/10
(58) Field of Search ..... 347/9, 10, 11

(56) References Cited

U.S. PATENT DOCUMENTS 6,024,438 A * 2/2000 Koike et al. ..... 347/43

FOREIGN PATENT DOCUMENTS

| | | | |
|---|---|---|---|
| EP | 0 124 190 | 11/1984 | |
| EP | 0 721 840 A2 | 7/1996 | ..... B41J/2/045 |
| EP | 0 788 882 A2 | 8/1997 | ..... B41J/2/04 |
| EP | 0 827 838 A2 | 3/1998 | ..... B41J/2/21 |
| EP | 0 874 329 | 10/1998 | |
| EP | 0 919 382 A2 | 6/1999 | ..... B41J/2/045 |
| JP | 4-15735 | 3/1992 | |
| JP | 11058719 A * | 3/1998 | ..... B41J/2/01 |
| JP | 11-5301 | 1/1999 | |

OTHER PUBLICATIONS

Japanese Office Action dated Jan. 23, 2002.

* cited by examiner

*Primary Examiner*—John Barlow
*Assistant Examiner*—Alfred E Dudding
(74) *Attorney, Agent, or Firm*—Sughrue Mion, PLLC

(57) ABSTRACT

A drive signal generating unit generates a drive signal sequence COM containing a first pulse, a fourth pulse, and a seventh pulse as a plurality of ejection pulse signals, a second pulse as a fine expansion waveform, and a sixth pulse as a fine contraction waveform. In the drive signal COM, the fourth pulse is placed between the second pulse and the sixth pulse. To finely vibrate a meniscus, the second pulse and the sixth pulse are selectively applied to a piezoelectric vibrator.

18 Claims, 12 Drawing Sheets

| GRADATION VALUE | 1ST PULSE | 2ND PULSE | 3RD PULSE | 4TH PULSE | 5TH PULSE | 6TH PULSE | 7TH PULSE | DECODED VALUE |
|---|---|---|---|---|---|---|---|---|
| 1 (00) | × | ○ | × | × | × | ○ | × | (0100010) |
| 2 (01) | × | × | × | ○ | × | × | × | (0001000) |
| 3 (10) | ○ | × | × | × | × | × | ○ | (1000001) |
| 4 (11) | ○ | × | × | ○ | × | × | ○ | (1001001) |

111
112
113
114
VP
P37
P38
P36
P32
P33
Vm'
P31
Vm
P34
VL
P35
P40
P41
Vm'

LIQUID JETTING APPARATUS, METHOD OF DRIVING THE SAME, AND COMPUTER-READABLE RECORD MEDIUM STORING THE METHOD

BACKGROUND OF THE INVENTION

This invention relates to a liquid jetting apparatus for jetting liquid of ink, glue, manicure, etc., through nozzle orifices and in particular to an apparatus intended for preventing liquid in nozzle orifices from being increased in viscosity.

Related arts will be discussed by taking an ink jet recording apparatus as one example of a liquid jetting apparatus. To record an image or a character on recording paper with an ink jet recording apparatus such as a printer or plotter, a recording head is moved in a main scanning direction and recording paper is moved in a subscanning direction and ink drops are jetted through nozzle orifices in association with their move. The ink drops are jetted, for example, by causing pressure variation to occur in liquid in pressure chambers communicating with the nozzle orifices.

In the nozzle orifices of the recording head, a meniscus, namely, a free surface of ink exposed on the nozzle orifices is exposed to air, thus an ink solvent (for example, water) evaporates gradually. If the ink viscosity in the nozzle orifices rises as the ink solvent evaporates, a problem of flying an ink drop in a direction deviated from the normal direction, etc., occurs. Thus, in the ink jet recording apparatus, countermeasures to prevent ink drops in the nozzle orifices from being increased in viscosity are taken. One of the countermeasures against an increase in viscosity of the ink drops is agitation of slight vibration of meniscuses.

In agitation, a vibration pulse signal is applied to a pressure generating element for causing pressure variation to occur in liquid in a pressure chamber and a meniscus is slightly moved (vibrated) in a jetting direction and an opposite direction thereof. As the meniscus is finely vibrated, ink in the nozzle orifice is mixed with any other ink in the pressure chamber for preventing ink from being increased in viscosity. Such agitation of ink is executed in association with the record operation. For example, it is executed during acceleration period just after main scanning of a carriage on which the recording head is mounted is started or during the one-line recording period. In agitation in the recording period (in-print vibration), a vibration pulse signal contained in a drive signal is selected and is supplied to the recording head.

By the way, for this kind of ink jet recording apparatus, improvements in the image quality and the recording speed are demanded. To attain high image quality, gradation representation with small dots is effective, and to speed up recording, record with large dots is effective. That is, to provide compatibility between high quality of a record image and speeding up of recording, it is useful to jet an ink drop capable of forming a small dot and an ink drop capable of forming a large dot through the same nozzle orifice.

Then, the following is considered: More than one ejection pulse signal capable of jetting a small amount of ink drop is contained in one recording period to make up a drive signal sequence and the ejection pulse signals are selectively applied to the recording head, whereby the volume of each ink drop jetted is changed. For example, three ejection pulse signals each for jetting a small ink drop of 13.3 pL (picoliters) are contained in one recording period (7.2 kHz) to make up a drive signal. The small ink drops are selectively jetted, whereby gradation representation is provided. On the other hand, to record at high speed, the three small ink drops are all jetted for recording a large dot on recording paper.

By the way, this kind of ink jet recording apparatus involves demand for furthermore speeding up record. To meet this demand, one recording period needs to be shortened as much as possible. However, it is difficult to shorten one recording period in a case where a plurality of ejection pulse signals and vibration pulse signals are simply connected. To use ink with relatively fast viscosity increase speed, such as pigment-family ink in contrast to dye-family ink, to jet minute ink drops, vibration of agitating ink in the vicinity of each nozzle orifice becomes indispensable for preventing an ink jet failure caused by an increase in ink viscosity.

SUMMARY OF THE INVENTION

It is therefore an object of the invention to provide a liquid jetting apparatus capable of shortening the repetition cycle of a drive signal while preventing liquid in the vicinity of a nozzle orifice from being increased in viscosity.

In order to achieve the above object, according to the present invention, a vibration pulse signal is separated into a pressure reducing element for reducing pressure of liquid in the pressure chamber to such an extent that a liquid drop is not ejected and a pressure increasing element for increasing pressure of liquid in the pressure chamber to such an extent that a liquid drop is not ejected. A drive signal sequence comprises at least one ejection element placed between the pressure reducing element and the pressure increasing element. The pressure reducing element and the pressure increasing element are selectively applied to the pressure generating element, thereby finely vibrating a meniscus. Thus, the time required for the pressure reducing element and the pressure increasing element mainly depend on the time of the gradient portion thereof.

Thus, if a plurality of ejection pulse signals and vibration pulse signals are mixed to make up a drive signal sequence, one unit printing period can be placed within a short time. Therefore, the repetition cycle of a drive signal can be shortened while liquid in the vicinity of a nozzle orifice is prevented from being increased in viscosity.

A sufficient time can be provided from application termination of the pressure reducing element to application start of the pressure increasing element. Thus, vibration caused by the waveform of one of the pressure reducing element and the pressure increasing element is settled to some extent before vibration caused by the waveform of the other can be started. Therefore, vibration of a meniscus can be carried out reliably without jetting any liquid drop.

The drive signal generated by the drive signal generator is a signal comprising at least the waveform of one of the pressure reducing element and the pressure increasing element placed between adjacent ejection pulse signals, so that the time between the ejection pulse signals which must be set to a relatively long time can be used effectively and if the jet drive and vibration pulse signals are mixed in the drive signal, one unit printing period can be placed within a short time.

The drive signal generated by the drive signal generator is a signal wherein at least either different potential levels between the pressure reducing element and the ejection pulse signal or different potential levels between the pressure increasing element and the ejection pulse signal are jointed by a connection element not applied to the pressure generating element, so that the time required for the connection element can be shortened as much as possible and the jet drive and vibration pulse signals can be mixed efficiently within one short unit printing period.

The invention can be embodied in various forms of a printing method, a printer, a computer program for providing the function of the printing method or the printer, a data signal containing the computer program which is provided in a carrier wave, and the like.

DETAILED DESCRIPTION OF THE PREFERRED EMBODIMENTS

Figure 1:
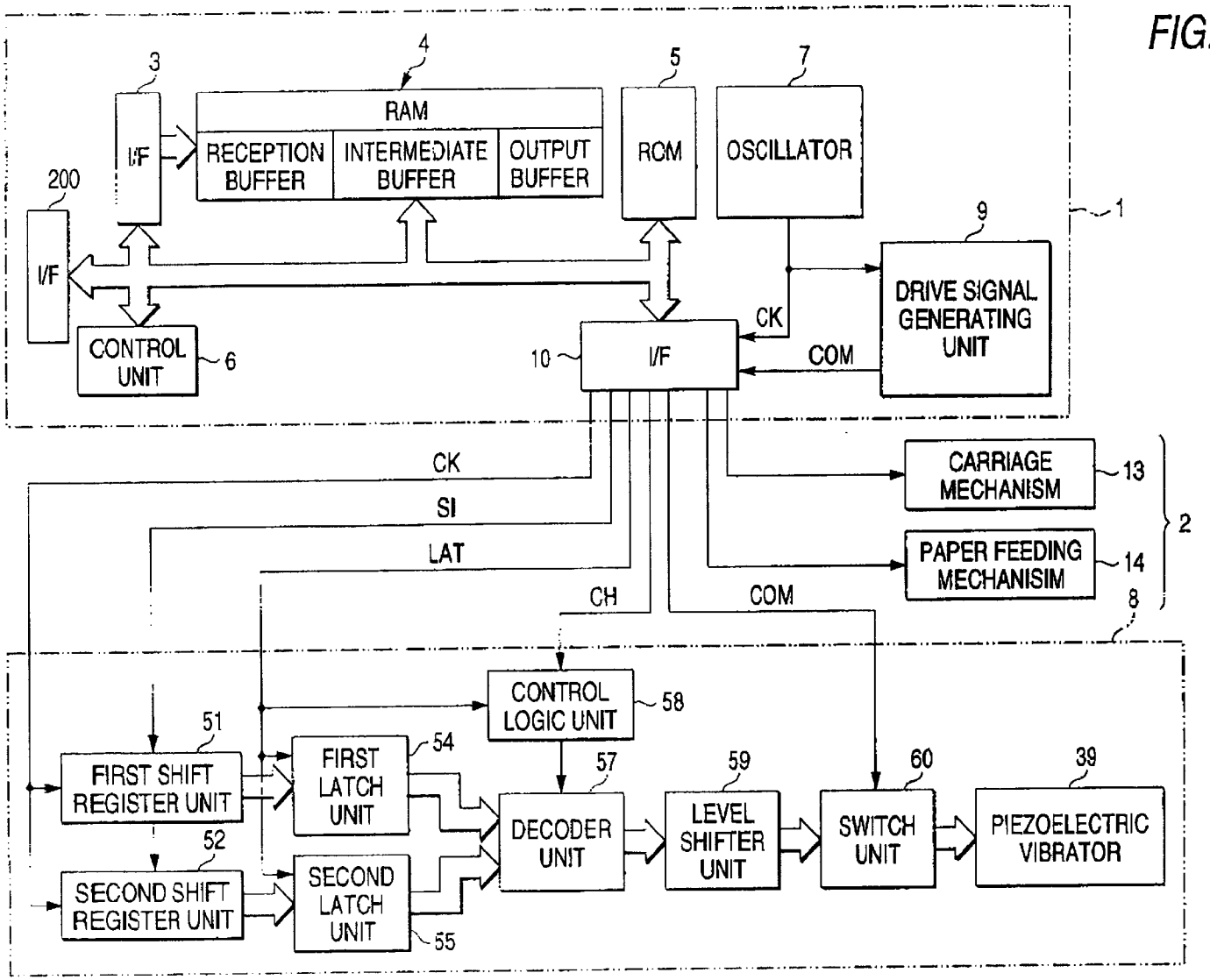
FIG. 1 is a block diagram to show the general configuration of an ink jet recording apparatus of the invention.

Referring now to accompanying drawings, there are shown preferred embodiments of the invention. FIG. 1 is a function block diagram of an ink jet printer of a representative ink jet recording apparatus.

The illustrated ink jet printer consists of a printer controller I and a print engine 2. The printer controller 1 comprises an interface for receiving print data, etc., from a host computer (not shown), etc., which will be hereinafter referred to as external I/F 3, RAM (random access memory) 4 for storing various pieces of data, etc., ROM (read-only memory) 5 storing various data processing routines, etc., a control unit 6 comprising a CPU (central processing unit), etc., an oscillator 7 for generating a clock signal (CK), a drive signal generating unit 9 for generating a drive signal (COM) supplied to a recording head 8, and an interface for transmitting gradation data (SI) to be expanded into dot pattern data, a drive signal, and the like to the print engine 2, which will be hereinafter referred to as internal I/F 10.

Figure 5:
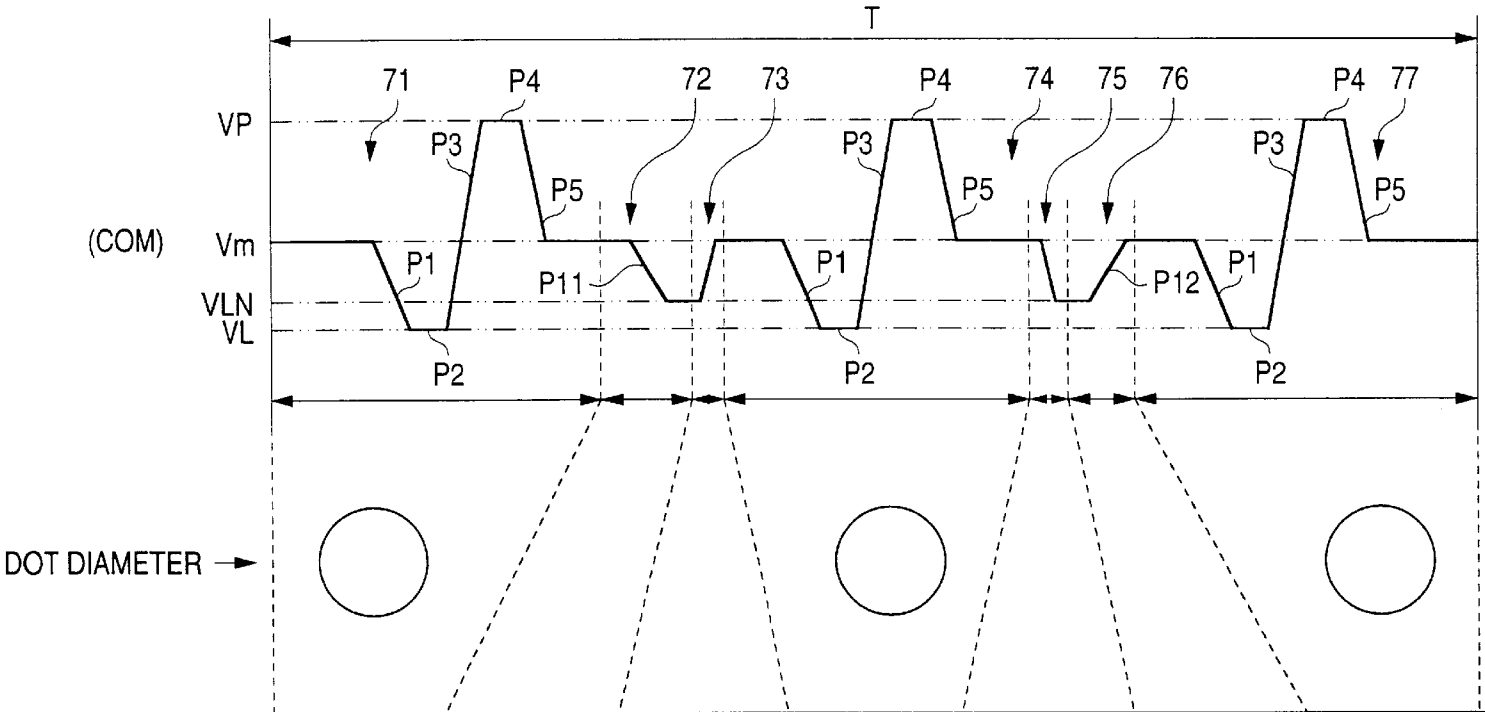
FIG. 5 is a drawing to describe the relationship between a drive signal and gradation value, etc.

The drive signal generating unit 9 constitutes a drive signal generator of the invention for generating a drive signal sequence containing a plurality of ejection pulse signals and vibration pulse signals. The drive signal generated by the drive signal generating unit 9 comprises a vibration pulse signal divided into a fine expansion waveform (corresponding to a second pulse 72) and a fine contraction waveform (corresponding to a sixth pulse 76) and at least one ejection pulse signal (corresponding to a fourth pulse 74) placed between the fine expansion waveform and the fine contraction waveform, as shown in FIG. 5. Further, the fine expansion waveform and the vibration pulse signal and the fine contraction waveform and the vibration pulse signal at different potential levels are joined by connection waveforms (a third pulse 73 and a fifth pulse 75). The drive signal will be described later in detail.

The external I/F 3 receives print data comprising any one or two or more of character code, graphic functions, and image data from the host computer, etc. The external I/F 3 outputs a busy signal (BUSY), an acknowledge signal (ACK), etc., to the host computer.

The RAM 4 is used as a reception buffer, an intermediate buffer, an output buffer, work memory (not shown), and the like. The print data received on the external I/F 3 from the host computer is temporarily stored in the reception buffer. Intermediate code data to be converted into intermediate code by the control unit 6 is stored in the intermediate buffer. Gradation data for each dot is expanded in the output buffer. The ROM 5 stores various control routines, font data, graphic functions, and various procedures, and the like executed by the control unit 6.

The control unit 6 reads the print data in the reception buffer, converts the data into intermediate code, and stores the intermediate code data in the intermediate buffer. The control unit 6 analyzes the intermediate code data read from the intermediate buffer, references the font data, the graphic functions, etc., in the ROM 5, and expands the intermediate code data into gradation data for each dot (dot pattern data). The gradation data is two-bit data, for example.

The provided gradation data is stored in the output buffer. When gradation data corresponding to one line of the recording head 8, the one-line gradation data is serially transmitted to the recording head 8 via the internal I/F 10. When the one-line gradation data is output from the output buffer, the contents of the intermediate buffer are cleared and the next intermediate code is converted.

The control unit 6 constitutes a part of a timing signal generator and outputs a latch signal (LAT) and a channel signal (CH) to the recording head 8 through the internal I/F 10. The latch signal and the channel signal define the supply start timing of the ejection pulse signals (first pulse 71, fourth pulse 74, seventh pulse 77 (see FIG. 5)), the fine expansion waveform (second pulse 72), and the fine contraction waveform (sixth pulse 76), etc., making up the drive signal (COM).

The print engine 2 comprises the recording head 8, a carriage mechanism 13, and a paper feeding mechanism 14. The carriage mechanism 13 is made up of a carriage on which the recording head 8 is mounted, a pulse motor for moving the carriage via a timing belt, etc., and the like for moving the recording head 8 in the main scanning direction. The paper feeding mechanism 14 is made up of a paper feeding motor, a paper feeding roller, and the like for feeding recording paper (a kind of print recording medium) in the subscanning direction.

Figure 2:
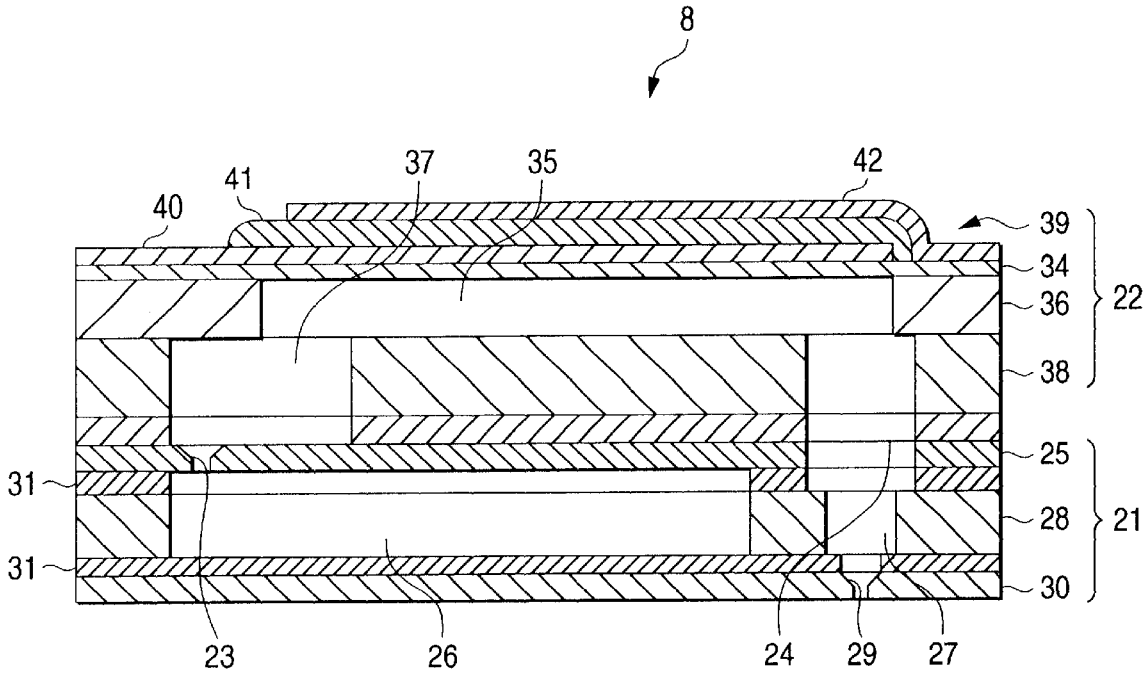
FIG. 2 is a schematic representation to show the mechanical structure of a recording head.

Next, the recording head 8 will be discussed in detail. First, the mechanical structure of the recording head 8 will be described. The illustrated recording head 8 is roughly made up of a channel unit 21 and an actuator unit 22, as shown in FIG. 2.

The channel unit 21 comprises an ink supply port formation substrate 25 formed with a through hole used as an ink supply port 23 and a through hole used as a part of a first nozzle communication hole 24, a reservoir formation substrate 28 formed with a through hole forming a reservoir 26 and a through hole used as a second nozzle communication hole 27, and a nozzle plate 30 comprising a plurality of (for example, sixty-four) nozzle orifices 29 arranged in the subscanning direction. The nozzle plate 30 is placed on the front of the reservoir formation substrate 28 (lower side of the figure) and the ink supply port formation substrate 25 is placed on the rear of the reservoir formation substrate 28 (upper side of the figure). Further, an adhesive layer 31 is placed between the reservoir formation substrate 28 and the nozzle plate 30 and an adhesive layer 31 is placed between the reservoir formation substrate 28 and the ink supply port formation substrate 25, thereby the ink supply port formation substrate 25, the reservoir formation substrate 28, and the nozzle plate 30 are integrally combined.

Actuator unit 22 is made up of a first lid member 34 serving as an elastic plate, a spacer 36 formed with through holes used as pressure chambers 35, a second lid member 38 formed with a through hole for forming a communication hole 37 and a through hole for forming a part of the first nozzle communication hole 24, and piezoelectric vibrators 39 constituting a pressure generating element of the invention. The first lid member 34 is placed on the rear of the spacer 36 and the second lid member 38 is placed on the front of the spacer 36, thereby the members are integrally combined.

The piezoelectric vibrators 39 are formed on the rear side of the first lid member 34 in a one-to-one correspondence with the pressure chambers 35. The piezoelectric vibrator 39 is a piezoelectric vibrator in a deflection vibration mode and consists of a common electrode 40 formed on the rear of the first lid member 34, a piezoelectric layer 41 deposited and formed on the rear of the common electrode 40, and a drive electrode 42 formed on the rear of each piezoelectric layer 41. When the piezoelectric vibrator 39 is charged, it is contracted for contracting the corresponding pressure chamber 35; when the piezoelectric vibrator 39 is discharged, it is extended for expanding the corresponding pressure chamber 35. That is, if the piezoelectric vibrator 39 is charged, it is contracted in a direction orthogonal to an electric field and the first lid member 34 becomes deformed as to project to the pressure chamber 35 side for contracting the corresponding pressure chamber 35. On the other hand, if the charged piezoelectric vibrator 39 is discharged, it is extended in the direction orthogonal to an electric field and the first lid member 34 becomes deformed in a restoration direction for expanding the corresponding pressure chamber 35.

In the described recording head 8, the ink flow passage from the reservoir 26 through the pressure chamber 35 to the nozzle orifice 29 is provided for each nozzle orifice 29. The potential level of the piezoelectric vibrator 39 is changed, whereby the volume of the corresponding pressure chamber 35 is changed and the pressure chamber 35 is compressed or decompressed. This means that pressure variation occurs in ink in the pressure chamber. If the ink pressure is controlled, an ink drop can be jetted through the nozzle orifice 29 or a meniscus (free surface of ink exposed on the nozzle orifice 29) can be finely vibrated.

To put it briefly, if the pressure chamber 35 in a steady state is once expanded and then is rapidly contracted, the ink pressure in the pressure chamber 35 rises rapidly and an ink drop is jetted through the nozzle orifice 29. The pressure chamber 35 is contracted after it is expanded to such an extent that no ink drop is jetted, whereby a meniscus is slightly moved in an ink jetting direction or an opposed direction thereof, thereby finely vibrated. As a result, ink in the vicinity of the nozzle orifice is agitated for preventing ink from being increased in viscosity.

Figure 3:
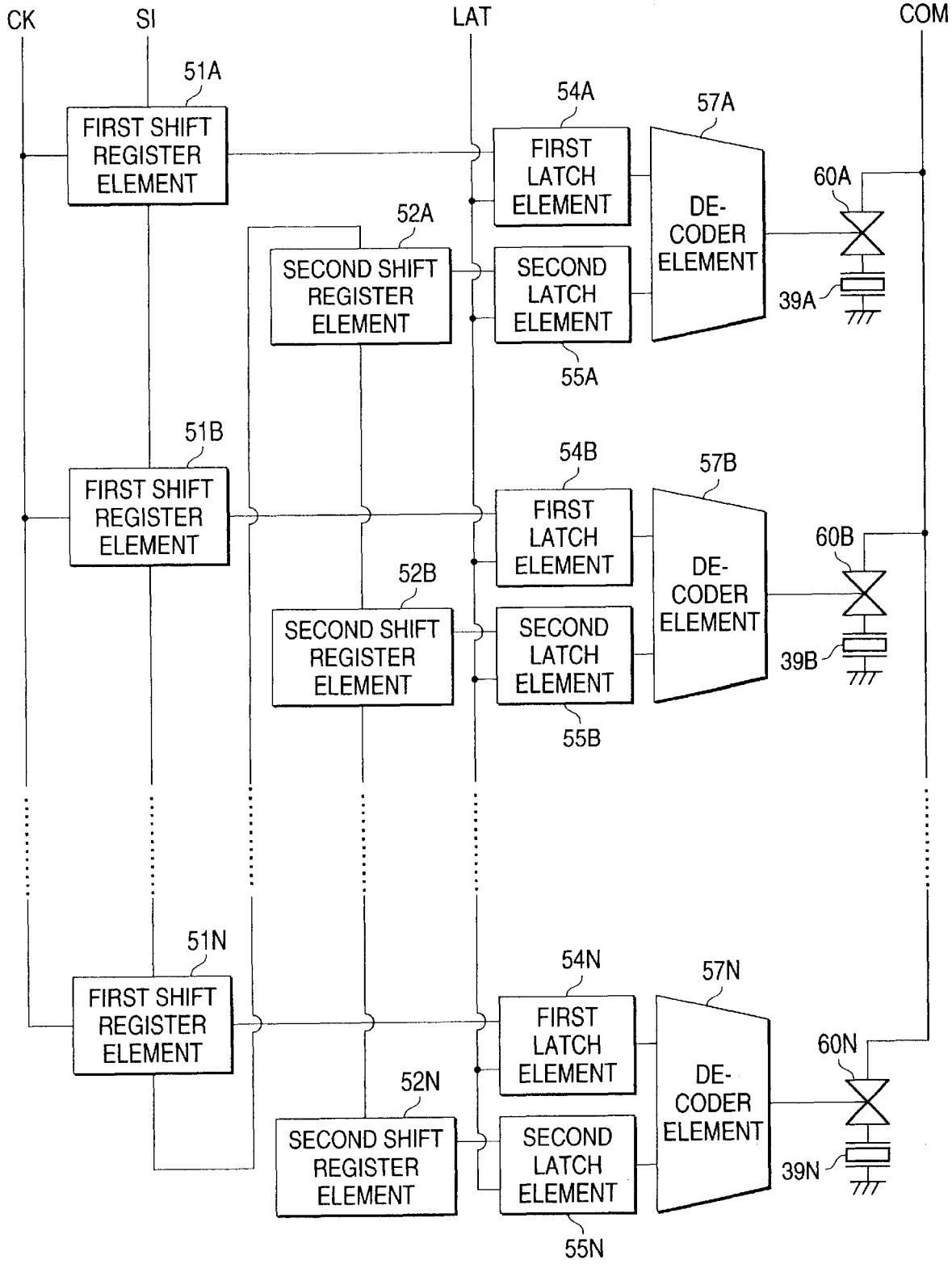
FIG. 3 is a circuit diagram to show the main part of a recording head drive circuit.

Next, the electrical configuration of the recording head 8 will be discussed with reference to FIGS. 1 and 3. In FIG. 3, a control logic unit 58 and a level shifter unit 59 shown in FIG. 1 are not shown.

The recording head 8 comprises a shift register section consisting of a first shift register unit 51 and a second shift register unit 52, a latch section consisting of a first latch unit 54 and a second latch unit 55, a decoder unit 57, the control logic unit 58, the level shifter unit 59, a switch unit 60, and piezoelectric vibrators 39. The first shift register unit 51, the second shift register unit 52, the first latch unit 54, the second latch unit 55, the decoder unit 57, the switch unit 60, and the piezoelectric vibrators 39 are provided in a one-to-one correspondence with the nozzle orifices 29 of the recording head 8. For example, as shown in FIG. 3, the recording head 8 comprises first shift register elements 51A to 51N, second shift register elements 52A to 52N, first latch elements 54A to 54N, second latch elements 55A to 55N, decoder elements 57A to 57N, switch elements 60A to 60N, and piezoelectric vibrators 39A to 39N.

The recording head 8 ejects ink drops and finely vibrates meniscuses based on gradation data (SI) from the printer controller 1. That is, the gradation data from the printer controller 1 is serially transmitted from the internal I/F 10 to the first shift register unit 51 and the second shift register unit 52 in synchronization with a clock signal (CLK) from the oscillator 7. The gradation data from the printer controller 1 is two-bit data such as (10) or (01), for example, and is set for each dot, namely, for each nozzle orifice 29. The data of the lower bit (bit 0) concerning all nozzle orifices 29 . . . is input to the first shift register elements 51A to 51N and the data of the higher bit (bit 1) concerning all nozzle orifices 29 is input to the second shift register elements 52A to 52N.

The first latch unit 54 is electrically connected to the first shift register unit 51 and the second latch unit 55 is electrically connected to the second shift register unit 52. When a latch signal (LAT) from the printer controller 1 is input to each latch unit 54, 55, the first latch unit 54 latches the data of the lower bit of the gradation data and the second latch unit 55 latches the data of the higher bit of the gradation data. That is, the gradation data input to the shift register elements 51A to 51N and 52A to 52N is latched in the latch elements 54A to 54N and 55A to 55N.

Each pair of the first shift register unit 51 and the first latch unit 54 and each pair of the second shift register unit 52 and the second latch unit 55 operating as described constitute each a storage circuit for temporarily storing the gradation data before input to the decoder unit 57.

The gradation data latched in each latch unit 54, 55 is input to the decoder unit 57 (decoder element 57A to 57N). The decoder unit 57 interprets the two-bit gradation data and generates seven-bit print data. The decoder unit 57, the control unit 6, the shift registers 51 and 52, and the latch units 54 and 55 serve as print data generation means for generating print data from gradation data, The bits of the print data correspond to the first pulse 71 to the seventh pulse 77 making up the drive signal (COM) shown in FIG.

5 and serve as selection information of the corresponding pulse signals. A timing signal from the control logic unit 58 is also input to the decoder unit 57. The control logic unit 58 serves as a timing signal generator together with the control unit 6 for generating a timing signal based on a latch signal (LAT) and a channel signal (CH).

The seven-bit print data interpreted by the decoder unit 57 is input to the level shifter unit 59 in order starting at the most significant data at the timing defined by the timing signal. The level shifter unit 59 serves as a voltage amplifier. When print data is "1," the level shifter unit 59 outputs an electric signal raised to a voltage capable of driving the switch unit 60, for example, a voltage of about several tens volts.

The print data of "1" provided by the level shifter unit 59 is supplied to the switch unit 60 serving as a switcher. A drive signal (COM) from the drive signal generating unit 9 is supplied to input of the switch unit 60 and the piezoelectric vibrator 39 is connected to output of the switch unit 60. The print data controls the operation of the switch unit 60. For example, while the print data applied to the switch unit 60 is "1," the drive signal is applied to the piezoelectric vibrator 39 for deforming the same. On the other hand, while the print data applied to the switch unit 60 is "0," an electric signal for operating the switch unit 60 is not output from the level shifter unit 59, so that no drive signal is applied to the piezoelectric vibrator 39. In short, the pulses of the first pulse 71 to the seventh pulse 77 set corresponding to the print data "1" are selectively applied to the piezoelectric vibrator 39.

Since the piezoelectric vibrator 39 holds potential like a capacitor, the piezoelectric vibrator 39 while the print data is "1" (while no drive signal is supplied) is maintained at the termination potential of the pulse signal supplied just before.

As seen from the description given above, in the embodiment, the control unit 6, the shift registers 51 and 52, the latch units 54 and 55, the decoder unit 57, the control logic unit 58, the level shifter unit 59, and the switch unit 60 serve as a pulse supplier of the invention for selecting any of the first pulse 71 to the seventh pulse 77 and supplying the selected pulse signal to the piezoelectric vibrator 39.

Figure 4:
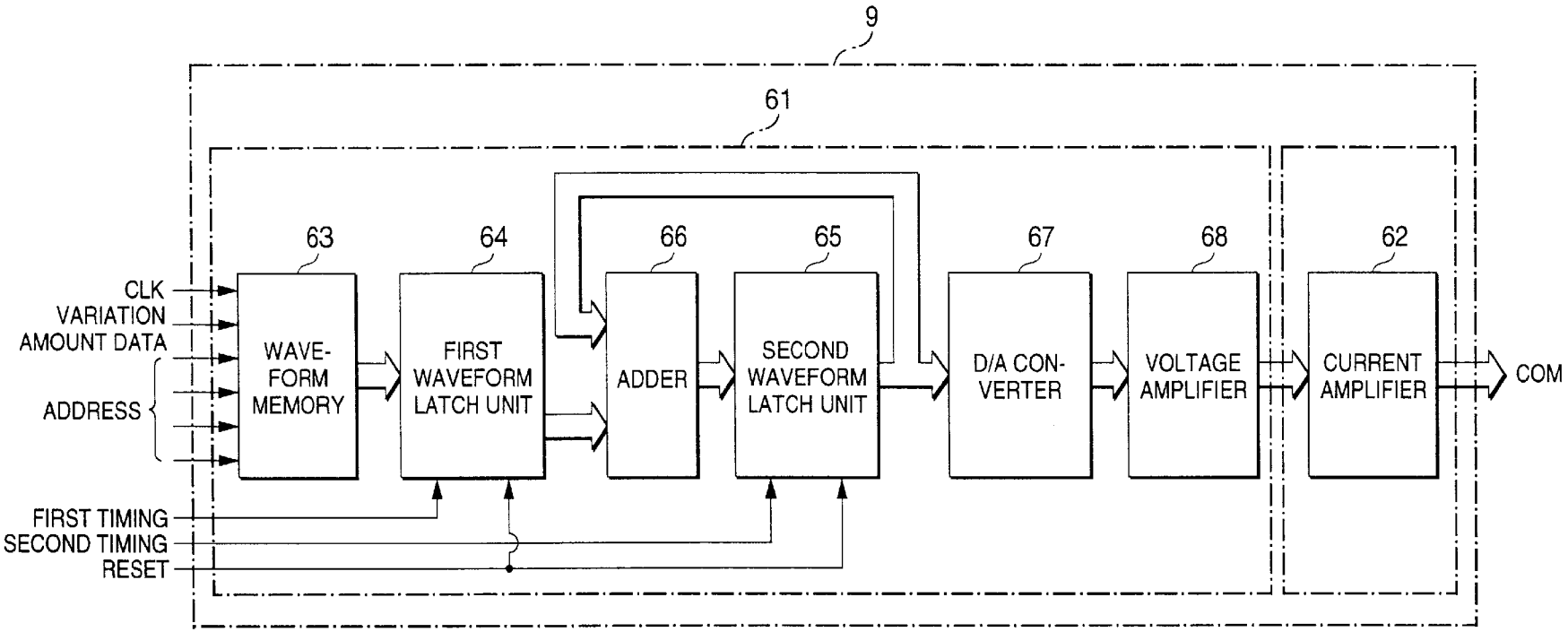
FIG. 4 is a block diagram to show the configuration of a drive signal generating unit.

The drive signal generating unit 9 comprises a waveform generating unit 61 and a current amplifier 62 as an example is shown in FIG. 4.

The waveform generating unit 61 comprises waveform memory 63, a first waveform latch unit 64, a second waveform latch unit 65, an adder 66, a D/A converter 67, and a voltage amplifier 68.

The waveform memory 63 serves as a variation amount data storage for separately storing data of different types of voltage variation amounts output from the control unit 6. The first waveform latch unit 64 is electrically connected to the waveform memory 63. The first waveform latch unit 64 holds the voltage variation amount data stored at a predetermined address of the waveform memory 63 in synchronization with a first timing signal. Output of the first waveform latch unit 64 and output of the second waveform latch unit 65 are input to adder 66 and the second waveform latch unit 65 is electrically connected to output of adder 66. Adder 66 serves as a variation amount data adder for adding the output signals together and outputting addition result.

The second waveform latch unit 65 is an output data holder for holding data output from adder 66 (voltage information) in synchronization with a second timing signal. The D/A converter 67 is electrically connected to output of the second waveform latch unit 65 and converts the output signal held in the second waveform latch unit 65 into an analog signal. The voltage amplifier 68 is electrically connected to output of the D/A converter 67 and amplifies analog signal provided by the D/A converter 67 to the voltage of the drive signal.

The current amplifier 62 is electrically connected to output of the voltage amplifier 68 and amplifies the current of the signal whose voltage is amplified by the voltage amplifier 68 and outputs the result as a drive signal (COM).

In the described drive signal generating unit 9, a plurality of variation amount data pieces indicating the voltage variation amounts are stored separately in a storage area of the waveform memory 63 prior to generation of a drive signal. For example, the control unit 6 outputs variation amount data and address data corresponding thereto to the waveform memory 63, which then stores the variation amount data in the storage area addressed by address data. The variation amount data is data containing positive or negative information (increment or decrement information) and address data is a four-bit address signal.

When different types of variation amount data are thus stored in the waveform memory 63, it is made possible to generate a drive signal.

To generate a drive signal, variation amount data is set in the first waveform latch unit 64 and the variation amount data set in the first waveform latch unit 64 is added to the output voltage from the second waveform latch unit 65 every predetermined update period.

Next, the drive signal (COM) generated by the drive signal generating unit 9 and ink jet control based on the drive signal will be discussed.

As shown in FIG. 5, the drive signal is a signal comprising a total of seven pulse signals of first pulse 71 to seventh pulse 77 connected in sequence. That is, the drive signal generating unit 9 generates the pulse signals repeatedly in every printing period T. The first pulse 71, the fourth pulse 74, and the seventh pulse 77 are ejection pulse signals each for operating the piezoelectric vibrator 39 so as to eject an ink drop. The pulses 71, 74, and 77 are of the same waveform, each consisting of an expansion element P1 for dropping potential on a constant gradient from intermediate potential Vm to lowest potential VL to such an extent that an ink drop is not ejected, an expansion hold element P2 for holding the lowest potential VL for a predetermined time, a ejection element P3 for raising potential on a steep gradient from the lowest potential VL to highest potential VP, a contraction hold element P4 for holding the highest potential VP for a predetermined time, and a damping element P5 for dropping potential from the highest potential VP to the intermediate potential Vm.

Whenever each of such pulse signals 71, 74, and 77 is applied to the piezoelectric vibrator 39, a small ink drop of about 13.3 pL, for example, is jetted through the nozzle orifice 29. That is, when the expansion element P1 is supplied to the piezoelectric vibrator 39, the piezoelectric vibrator 39 is bent and the pressure chamber 35 is expanded relatively moderately and is decompressed. Subsequently, the expansion hold element P2 is supplied, whereby the pressure chamber 35 is maintained in the expansion state. Then, the ejection element P3 is supplied, the piezoelectric vibrator 39 is bent to the opposite side, and the pressure chamber 35 is contracted in an extremely short time and is maintained in this contraction state over the supply period of the contraction hold element P4. As the ejection element P3 and the contraction hold element P4 are supplied, ink in the pressure chamber 35 is rapidly compressed and an ink drop is jetted through the nozzle orifice 29. Subsequently, the damping element P5 is supplied and the pressure chamber 35 is expanded moderately, settling waving of a meniscus after the ink drop is jetted.

The pulse signals 71, 74, and 77 are placed at constant intervals. That is, the pulse signals are generated at the same intervals. For example, the time interval between the start end of the expansion element P1 of the first pulse 71 and the start end of the expansion element P1 of the fourth pulse 74 and the time interval between the start end of the expansion element P1 of the fourth pulse 74 and the start end of the expansion element P1 of the seventh pulse 77 are set so that they become the same. Further, the fourth pulse 74 is placed almost in the middle of the unit printing period T. In other words, the fourth pulse 74 is generated at the timing of roughly a half the unit printing period T.

The second pulse 72 is a fine expansion waveform and the sixth pulse 76 is a fine contraction waveform. The second pulse 72 and the sixth pulse 76 are signals provided by dividing a vibration pulse signal into two pieces with regard to a time axis direction. The second pulse 72 of one division waveform element contains a fine expansion element P11. This fine expansion element P11 constitutes a pressure reducing element of the invention for dropping potential on a moderate gradient from the intermediate potential Vm to second lowest potential VLN to such an extent that an ink drop is not ejected. The second lowest potential VLN is set to potential a little higher than the lowest potential VL. The sixth pulse 76 of the other division waveform element contains a fine contraction element P12. This fine contraction element P12 constitutes a pressure increasing element of the invention for raising potential on a moderate gradient from the second lowest potential VLN to the intermediate potential Vm to such an extent that an ink drop is not ejected. Therefore, the vibration pulse signal is divided into the second pulse 72 and the sixth pulse 76 so that the pressure reducing element and the pressure increasing element are separated.

When the second pulse 72 and the sixth pulse 76 are applied to the piezoelectric vibrator 39, the pressure chamber 35 and a meniscus operate as follows: The pressure chamber 35 is expanded relatively moderately with application of the fine expansion element P11 of the second pulse 72 and the meniscus is slightly moved toward the pressure chamber 35. Since the piezoelectric vibrator 39 is held at the VLN while the drive signal is not supplied, the pressure chamber 35 is maintained in the expansion state and the meniscus is freely vibrated. Then, the pressure chamber 35 is contracted moderately with application of the fine contraction element P12 of the sixth pulse 76 and the meniscus is vibrated slightly toward the ink jetting direction. As this operation sequence is performed, the meniscus is vibrated in the vicinity of the nozzle orifice 29 and ink in this portion is agitated.

The second pulse 72 of a fine expansion waveform is placed between the first pulse 71 of the first ejection pulse signal and the fourth pulse 74 of the second ejection pulse signal. The sixth pulse 76 of a fine contraction waveform is placed between the fourth pulse 74 of the second ejection pulse signal and the seventh pulse 77 of the third ejection pulse signal. That is, the ejection element P3 of the fourth pulse 74 is placed between the second pulse 72 and the sixth pulse 76.

The second pulse 72 and the sixth pulse 76 are selected if none of the first pulse 71, the fourth pulse 74, and the seventh pulse 77 are selected, as described later. In other words, if any one of the first pulse 71, the fourth pulse 74, and the seventh pulse 77 is selected, the second pulse 72 and the sixth pulse 76 are not selected. The time required for the second pulse 72 is determined by the time of the fine expansion element P11 of the gradient portion and the time required for the sixth pulse 76 is determined by the time of the fine contraction element P12 of the gradient portion. Thus, if the first, fourth, and seventh pulses 71, 74, and 77 as a plurality of ejection pulse signals and the second and sixth pulses 72 and 76 as vibration pulse signals are mixed in the drive signal, a unit printing period T can be placed within a short time.

Since a sufficient time can be provided between the second pulse 72 and the sixth pulse 76, vibration caused by the sixth pulse 76 can be started after vibration caused by the second pulse 72 is settled to some extent. As a result, fine vibrating of the meniscus can be executed effectively.

Further, the second pulse 72 and the sixth pulse 76 can be placed separately, so that the range in which the time interval between the second pulse 72 and the sixth pulse 76 can be set can also be widened.

The second pulse 72 as a fine expansion waveform is placed between the first pulse 71 as the first ejection pulse signal and the fourth pulse 74 as the second ejection pulse signal. Likewise, the sixth pulse 76 as a fine contraction waveform is placed between the fourth pulse 74 as the second ejection pulse signal and the seventh pulse 77 as the third ejection pulse signal. For adjacent ejection pulse signals, preferably a reasonable time interval is placed between the termination of the damping element P5 in the preceding ejection pulse signal and the start end of the expansion element P1 in the following ejection pulse signal to make it hard to give the effect of jetting an ink drop by the preceding ejection pulse signal to jetting an ink drop by the following ejection pulse signal.

That is, the meniscus is largely vibrated just after an ink drop is jetted by the preceding ejection pulse signal. If an ink drop is jetted by the following ejection pulse signal in a state in which vibration of the meniscus is large, a problem of causing variations in ink amounts of later ink drops, etc., occurs. If the second pulse 72 or the sixth pulse 76 is placed between adjacent ejection pulse signals as described above, the jet drive and vibration pulse signals can be placed efficiently within a short unit printing period even if a time interval is placed between the ejection pulse signals.

Further, since the second pulse 72 and the sixth pulse 76 are dedicated waveforms to form vibration pulse signals, the potential gradient and the potential difference (for example, VLN level) can be set relatively freely. Thus, optimum vibration of the meniscus can be executed in response to the ink properties of viscosity, etc., and the shape of the pressure chamber 35.

By the way, the third pulse 73 placed between the second pulse 72 and the fourth pulse 74 is a connection waveform for joining different potential levels of the termination potential of the second pulse 72 (VLN) and the start end potential of the fourth pulse 74 (Vm). Likewise, the fifth pulse 75 placed between the fourth pulse 74 and the sixth pulse 76 is a connection waveform for joining different potential levels of the termination potential of the fourth pulse 74 (Vm) and the start end potential of the sixth pulse 76 (VLN). The third pulse 73 and the fifth pulse 75 are contained in the drive signal, but are not applied to the piezoelectric vibrator 39. Thus, for the third pulse 73 and the fifth pulse 75, the inclination of the gradient portion (namely, connection element) can be set to a steep gradient. That is, the time required for the third pulse 73 and the fifth pulse 75 can be shortened as much as possible. Also in this point, a plurality of ejection pulse signals and vibration pulse signals can be placed efficiently within a short unit printing period.

Figure 7:
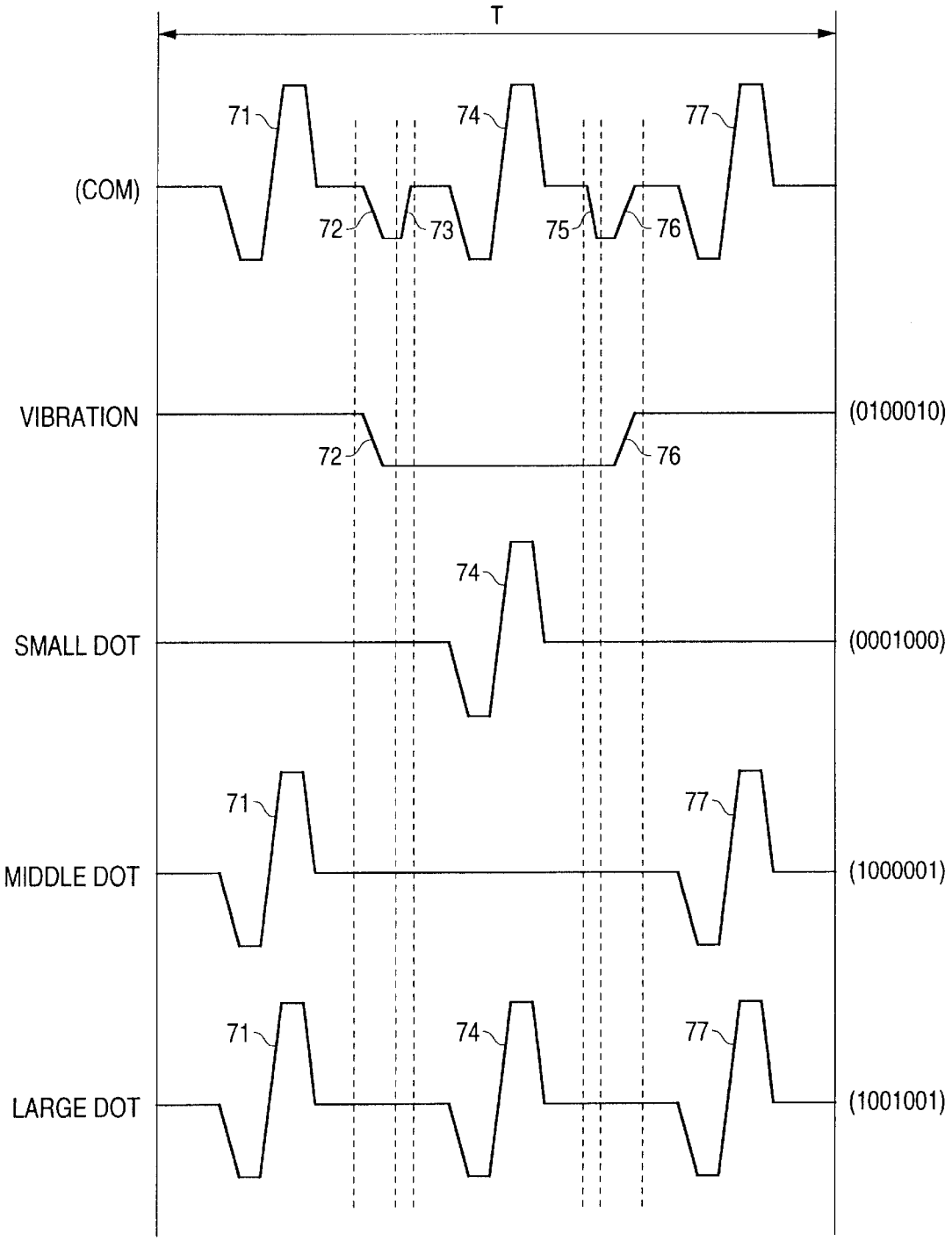
FIG. 7 is a chart to describe pulse signal selection patterns according to a first embodiment of the invention.

Next, a procedure of selecting the pulses and executing multi-gradation record will be discussed with reference to FIGS. 5 and 7. In the description to follow, gradation representation based on four patterns of no dot for finely vibrating a meniscus without recording a dot (namely, without jetting an ink drop) (gradation value 1), a small dot for jetting one small ink drop (gradation value 2), a middle dot for jetting two small ink drops (gradation value 3), and a large dot for jetting three small ink drops (gradation value 4) will be covered.

In this case, the gradation values can be represented by two-bit gradation data by setting gradation value 1 to (00), gradation value 2 to (01), gradation value 3 to (10), and gradation value 4 to (11).

For the gradation value 1, namely, to finely vibrate a meniscus, the second pulse 72 and the sixth pulse 76 are applied to the piezoelectric vibrator 39 in order. That is, the gradation data (00) indicating the gradation value 1 is interpreted by the decoder unit 57 to generate seven-bit print data (0100010). The data bits making up the print data are output from the decoder unit 57 in order in synchronization with the generation timings of the first pulse 71 to the seventh pulse 77, whereby the switch unit 60 is set to a connection state over the period of data bit "1." Thus, the second pulse 72 and the sixth pulse 76 are selectively supplied to the piezoelectric vibrator 39 out of the drive signal and the meniscus is finely vibrated. As a result, ink in the vicinity of the nozzle orifice 29 is agitated.

For the gradation value 2, namely, to record a small dot, for example, the fourth pulse 74 is applied to the piezoelectric vibrator 39. That is, the gradation data (01) indicating the gradation value 2 is interpreted by the decoder unit 57 to generate seven-bit print data (0001000). The data bits are output from the decoder unit 57 in order in synchronization with the generation timings of the first pulse 71 to the seventh pulse 77. Thus, only the fourth pulse 74 is selectively supplied to the piezoelectric vibrator 39 out of the drive signal and one small ink drop corresponding to the fourth pulse 74 is jetted. As a result, a small dot is formed on recording paper. Thus, to jet a small ink drop capable of forming a small dot, the pulse supplier (control unit 6, shift register units 51 and 52, latch units 54 and 55, decoder unit 57, control logic unit 58, level shifter unit 59, and switch unit 60) selects only the fourth pulse 74. The fourth pulse 74 is sandwiched between the first pulse 71 and the seventh pulse 77 placed at both end parts in the drive signal.

Likewise, for the gradation value 3, namely, to record a middle dot, for example, the first pulse 71 and the seventh pulse 77 are applied to the piezoelectric vibrator 39. That is, the gradation data (10) indicating the gradation value 3 is interpreted by the decoder unit 57 to generate seven-bit print data (1000001). The print data bits are output from the decoder unit 57 in order in synchronization with the generation timings of the first pulse 71 to the seventh pulse 77. Thus, the first pulse 71 and the seventh pulse 77 are selectively supplied to the piezoelectric vibrator 39 out of the drive signal and two small ink drops are jetted in response to the first pulse 71 and the seventh pulse 77. As a result, a middle dot is formed on recording paper. Thus, to jet a middle ink drop capable of forming a middle dot, the pulse supplier selects the first pulse 71 and the seventh pulse 77 placed at both end parts in the drive signal.

Likewise, for the gradation value 4, namely, to record a large dot, for example, the first pulse 71, the fourth pulse 74, and the seventh pulse 77 are applied to the piezoelectric vibrator 39. That is, the gradation data (11) indicating the gradation value 4 is interpreted by the decoder unit 57 to generate seven-bit print data (1001001). The print data bits are output from the decoder unit 57 in order in synchronization with the generation timings of the first pulse 71 to the seventh pulse 77. Thus, the first pulse 71, the fourth pulse 74, and the seventh pulse 77 are selectively supplied to the piezoelectric vibrator 39 out of the drive signal and three small ink drops are jetted in response to the first pulse 71, the fourth pulse 74, and the seventh pulse 77, then a large dot is formed on recording paper. Thus, to jet a large ink drop capable of forming a large dot, the pulse supplier selects all ejection pulses contained in the drive signal (first pulse 71, fourth pulse 74, and seventh pulse 77).

As seen from the description given above, the pulse supplier of the embodiment changes amount of the ink drop to be jetted by changing the number of the selected ejection pulse signals (pulses 71, 74, and 77). The pulse supplier selects the fourth pulse 74 to jet a small ink drop, selects the first pulse 71 and the seventh pulse 77 to jet a middle ink drop, and selects all the pulses 71, 74, and 77 to jet a large ink drop.

Since the fourth pulse 74 selected to jet a small ink drop is placed almost at the middle of the unit printing period T, a small dot can be recorded at the center in the main scanning direction in a dot formation area on recording paper (area where one dot can be hit). Likewise, the first pulse 71 and the seventh pulse 77 selected to jet a middle ink drop are placed with the fourth pulse 74 between and the pulses 71, 74, and 77 are placed at equal intervals, so that the hit center of the middle dot and that of the small dot can be matched with each other. Likewise, the hit center of the small dot and that of the large dot can also be matched with each other. Consequently, if different types of ink drops different in amount are jetted through the same nozzle orifice, the hit center of the dot formed by each type of ink drop is matched with the center of the dot formation area and the image quality can be still more improved.

In the gradation values 1 to 4, the bits corresponding to the third pulse 73 and the fifth pulse 75 are always set to "0." This is because the third pulse 73 and the fifth pulse 75 are pulses not applied to the piezoelectric vibrator 39.

Figure 6:
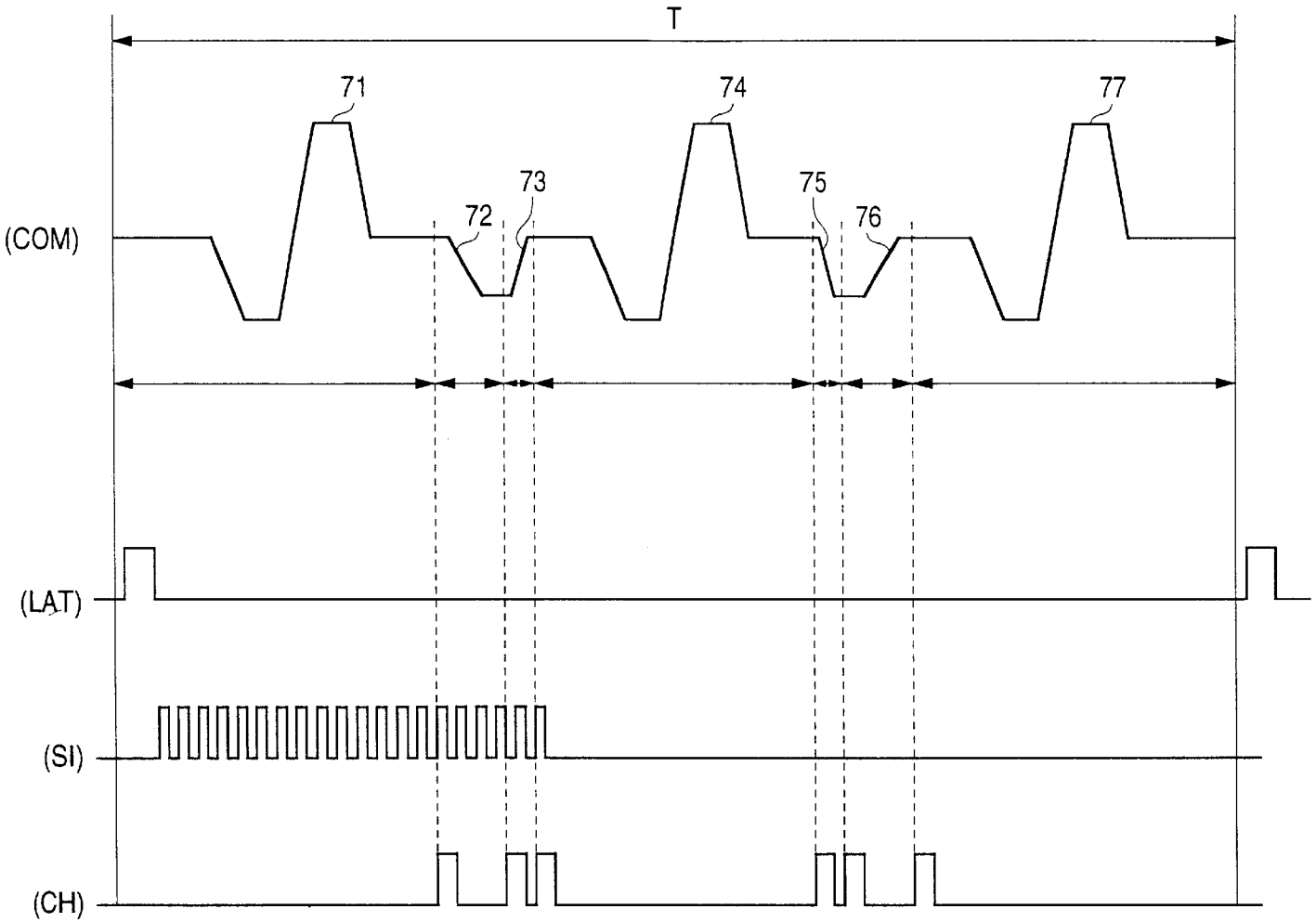
FIG. 6 is a timing chart to show the relationship between drive pulses of a drive signal and gradation data transfer timing, etc.

Next, a specific procedure for supplying the seven-bit print data to the switch unit 60 will be discussed with reference to FIG. 6.

First, the gradation data stored in the output buffer of the RAM 4 is transferred to the shift register units 51 and 52 within the immediately preceding unit printing period. A latch signal is supplied at the start timing of a unit printing period T, thereby latching the gradation data in the latch units 54 and 55. When the gradation data is latched in the latch units 54 and 55, the decoder unit 57 interprets the gradation data to generate seven-bit print data (D1, D2, D3, D4, D5, D6, D7) where D1 is a selection signal of the first pulse 71, D2 is a selection signal of the second pulse 72, D3 is a selection signal of the third pulse 73, D4 is a selection signal of the fourth pulse 74, D5 is a selection signal of the fifth pulse 75, D6 is a selection signal of the sixth pulse 76, and D7 is a selection signal of the seventh pulse 77.

The latch signal is also input to the control logic unit 58, which then outputs a timing signal to the decoder unit 57 as the control logic unit 58 receives the latch signal. Upon reception of the timing signal, the decoder unit 57 outputs the print data D1 to the level shifter unit 59. Upon reception of the print data D1 set to "1," the level shifter unit 59 outputs an electric signal with voltage raised to place the switch unit 60 in a connection state. Thus, the switch unit 60 corresponding to the print data D1 set to "1" is placed in the =connection state and the first pulse 71 is applied to the piezoelectric vibrator 39.

Subsequently, when the supply start timing of the second pulse 72 comes, a channel signal (CH) is output to the control logic unit 58. Upon reception of the channel signal, the control logic unit 58 outputs a timing signal to the decoder unit 57. As the decoder unit 57 receives the timing signal, it outputs the print data D2 to the level shifter unit 59. Upon reception of the print data D2 set to "1," the level shifter unit 59 outputs an electric signal with voltage raised to place the switch unit 60 in a connection state. Thus, the switch unit 60 corresponding to the print data D2 set to "1" is placed in the connection state and the second pulse 72 is applied to the piezoelectric vibrator 39.

When the supply start timing of the third pulse 73 comes, a channel signal is again output to the control logic unit 58, which then outputs a timing signal to the decoder unit 57. As the decoder unit 57 receives the timing signal, it outputs the print data D3 to the level shifter unit 59. Since the print data D3 is always set to "0," the third pulse 73 is not applied to the piezoelectric vibrator 39.

Whenever the supply start timing of the fourth pulse 74, the supply start timing of the fifth pulse 75, the supply start timing of the sixth pulse 76, and the supply start timing of the seventh pulse 77 come in order, a channel is output to the control logic unit 58 and above-described processing is repeated.

If the print data D4 is "1," the fourth pulse 74 is applied to the piezoelectric vibrator 39; if the print data D6 is "1," the sixth pulse 76 is applied to the piezoelectric vibrator 39; and if the print data D7 is "1," the seventh pulse 77 is applied to the piezoelectric vibrator 39. Since the print data D5 is always set to "0," the fifth pulse 75 is not applied to the piezoelectric vibrator 39.

Consequently, as previously described with reference to FIG. 7, to finely vibrate a meniscus, the second pulse 72 and the sixth pulse 76 are applied to the piezoelectric vibrator 39 based on the print data (0100010). To record a small dot, the fourth pulse 74 is applied to the piezoelectric vibrator 39 based on the print data (0001000) for jetting one small ink drop. To record a middle dot, the first pulse 71 and the seventh pulse 77 are applied to the piezoelectric vibrator 39 based on the print data (1000001) for jetting two small ink drops. To record a large dot, the first pulse 71, the fourth pulse 74, and the seventh pulse 77 are applied to the piezoelectric vibrator 39 based on the print data (1001001) for jetting three small ink drops.

In the description of the first embodiment, as the vibration pulse signal, the signal for expanding the pressure chamber 35 in a steady state and holding the pressure chamber 35 in the expansion state for the predetermined time and then contracting the pressure chamber 35 for restoring the pressure chamber 35 to the steady state is taken as an example. However, the vibration pulse signal is not limited to the signal. For example, it may be a vibration pulse signal for contracting the pressure chamber 35 from a steady state and holding the pressure chamber 35 in the contraction state for a predetermined time and then expanding the pressure chamber 35 for restoring the pressure chamber 35 to the steady state.

By the way, in the first embodiment, the second pulse 72 having the pressure reducing element and the sixth pulse 76 having the pressure increasing element are provided separately from the first pulse 71, the fourth pulse 74, and the seventh pulse 77 as the ejection pulse signals. However, the invention is not limited to the configuration. For example, the pressure reducing element may be used as a decompression element forming a part of ejection pulse signal. Another embodiments adopting such a configuration will be discussed.

Figure 8:
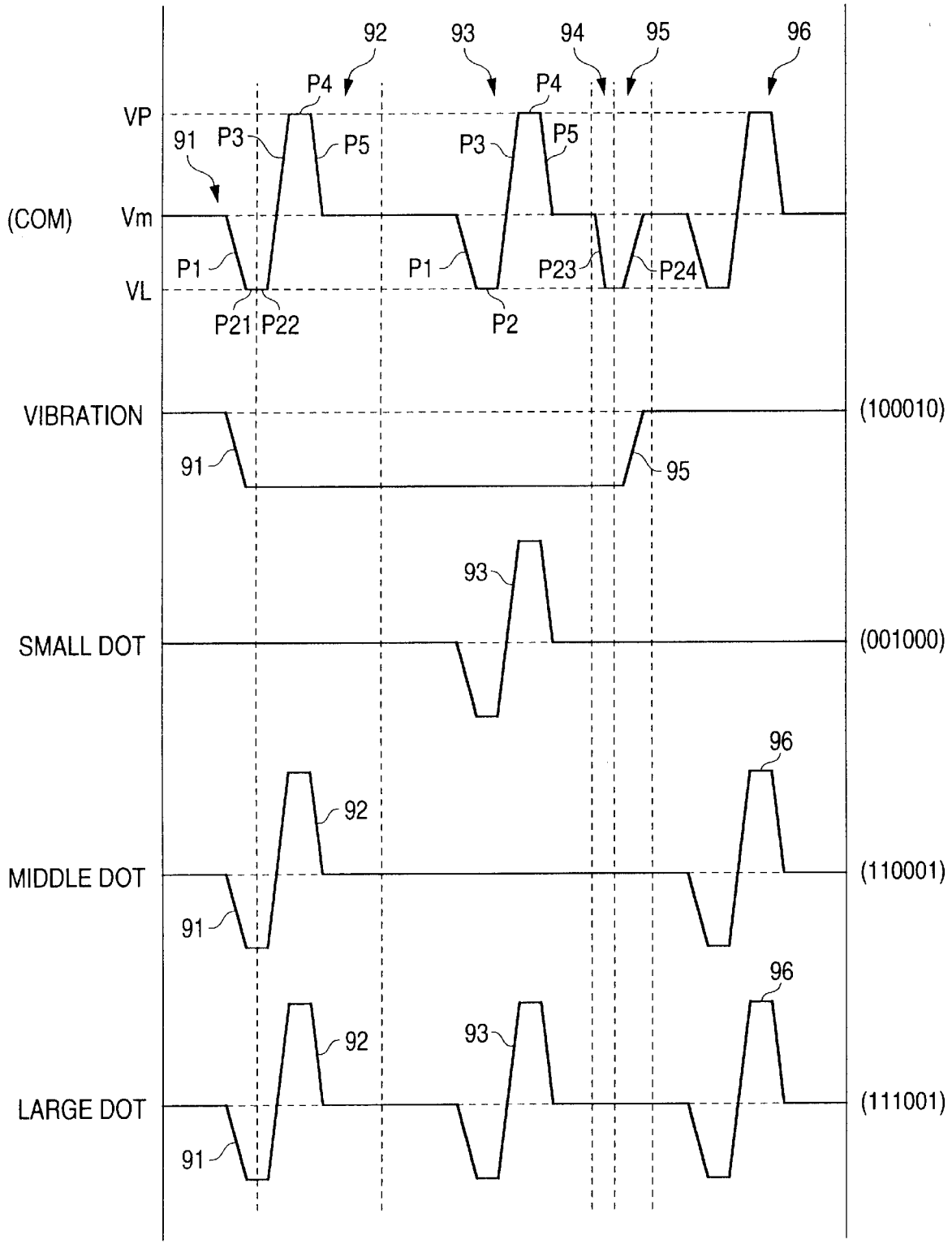
FIG. 8 is a chart to describe pulse signal selection patterns according to a second embodiment of the invention.

A second embodiment of the invention will be discussed. FIG. 8 is a chart to describe a drive signal generated by a drive signal generating unit 9 in the second embodiment of the invention. Other components of the second embodiment are identical with those of the first embodiment and therefore will not be discussed again.

As shown in FIG. 8, the drive signal generated by the drive signal generating unit 9 is a signal comprising a total of six drive pulses of first pulse 91 to sixth pulse 96 connected in sequence.

The first pulse 91 is one waveform element of two vibration pulse divisions and comprises an expansion element P1 and a first expansion hold element P21. The expansion element P1 also serves as a decompression element which constitutes the pressure reducing element of the invention, and is an element for dropping potential on a constant gradient from intermediate potential Vm to lowest potential VL to such an extent that an ink drop is not ejected as in the first embodiment. The first expansion hold element P21 is an element for holding the lowest potential VL for an extremely short time.

The second pulse 92 comprises a second expansion hold element P22, a ejection element P3, a contraction hold element P4, and a damping element P5. The second expansion hold element P22 is an element for holding the lowest potential VL for an extremely short time. The ejection element P3, the contraction hold element P4, and the damping element P5 are similar to those in the first embodiment. That is, the ejection element P3 is an element for raising potential on a steep gradient from the lowest potential VL to highest potential VP, the contraction hold element P4 is an element for holding the highest potential VP for a predetermined time, and the damping element PS is an element for dropping potential from the highest potential VP to the intermediate potential Vm.

The first pulse 91 and the second pulse 92 make up an ejection pulse and are applied consecutively to a piezoelectric vibrator 39, thereby jetting a small ink drop through a nozzle orifice 29. That is, the ejection pulse made up of the first pulse 91 and the second pulse 92 has a function equivalent to that of the first pulse 71 in the first embodiment. Therefore, it can be said that the first pulse 91 and the second pulse 92 are waveforms provided by dividing the first pulse 71 into two parts with regard to a time axis direction in an intermediate point of expansion hold element P2.

The third pulse 93 and the sixth pulse 96 are ejection pulse signals for operating the piezoelectric vibrator 39 so as to jet an ink drop and comprise each an expansion element P1, a contraction hold element P2, a ejection element P3, a contraction hold element P4, and a damping element P5. The third pulse 93 corresponds to the fourth pulse 74 in the first embodiment and the sixth pulse 96 corresponds to the seventh pulse 77 in the first embodiment. Therefore, if the third pulse 93 or the sixth pulse 96 is applied to the piezoelectric vibrator 39, a small ink drop is jetted through the nozzle orifice 29.

The fourth pulse 94 is a connection waveform containing a connection element P23 for joining different potential levels of the termination potential of the third pulse 93 (Vm) and the start end potential of the fifth pulse 95 (VL). Since the fourth pulse 94 is not applied to the piezoelectric vibrator 39, a steep gradient can be set. Therefore, the fourth pulse 94 enables a plurality of pulse signals to be placed more efficiently within a short unit printing period.

The fifth pulse 95 is the other waveform element of two vibration pulse divisions (fine contraction waveform) and contains a fine contraction element P24. The fine contraction element P24 is also a kind of a pressure increasing element of the invention and the start end potential is matched with the lowest potential VL which is the same as the termination potential of the expansion element P1. That is, the fine contraction element P24 is an element for raising potential on a moderate gradient from the lowest potential VL to the intermediate potential Vm to such an extent that an ink drop is not ejected.

To finely vibrate a meniscus, the first pulse 91 and the fifth pulse 95 are applied to the piezoelectric vibrator 39 in order. That is, gradation data (00) is interpreted by a decoder unit 57 to generate six-bit print data (100010). The data bits are output from the decoder unit 57 in order in synchronization with the generation timings of the first pulse 91 to the sixth pulse 96, whereby the first pulse 91 and the fifth pulse 95 are selectively supplied to the piezoelectric vibrator 39 out of the drive signal and the meniscus is finely vibrated.

To record a small dot, the third pulse 93 is applied to the piezoelectric vibrator 39; to record a middle dot, the first pulse 91, the second pulse 92, and the sixth pulse 96 are applied to the piezoelectric vibrator 39; and to record a large dot, the first pulse 91, the second pulse 92, the third pulse 93, and the sixth pulse 96 are applied to the piezoelectric vibrator 39. That is, gradation data is interpreted by the decoder unit 57 to generate print data (001000) for recording a small dot, to generate print data (110001) for recording a middle dot, and to generate print data (111001) for recording a large dot. The bits of the generated print data are output from the decoder unit 57 in order in synchronization with the generation timings of the first pulse 91 to the sixth pulse 96.

Thus, in the embodiment, the expansion element P1 of the first pulse 91 functioning as the pressure reducing element is also used as the decompression element forming a part of ejection pulse signal, so that the number of waveforms dedicated to vibration can be decreased and a plurality of pulse signals can be placed efficiently within a short unit printing period.

By the way, a large number of types of ink used with this kind of ink jet recording apparatus exist because a large number of color materials, solvents, additives, etc., used exist. The optimum condition for finely vibrating a meniscus also varies depending on the type of ink, more particularly, the physical properties of ink. Thus, preferably the vibration condition is changed in response to the type of ink jetted. Then, a third embodiment and a fourth embodiment intended for making it possible to change the vibration condition of a meniscus will be discussed.

Figure 9:
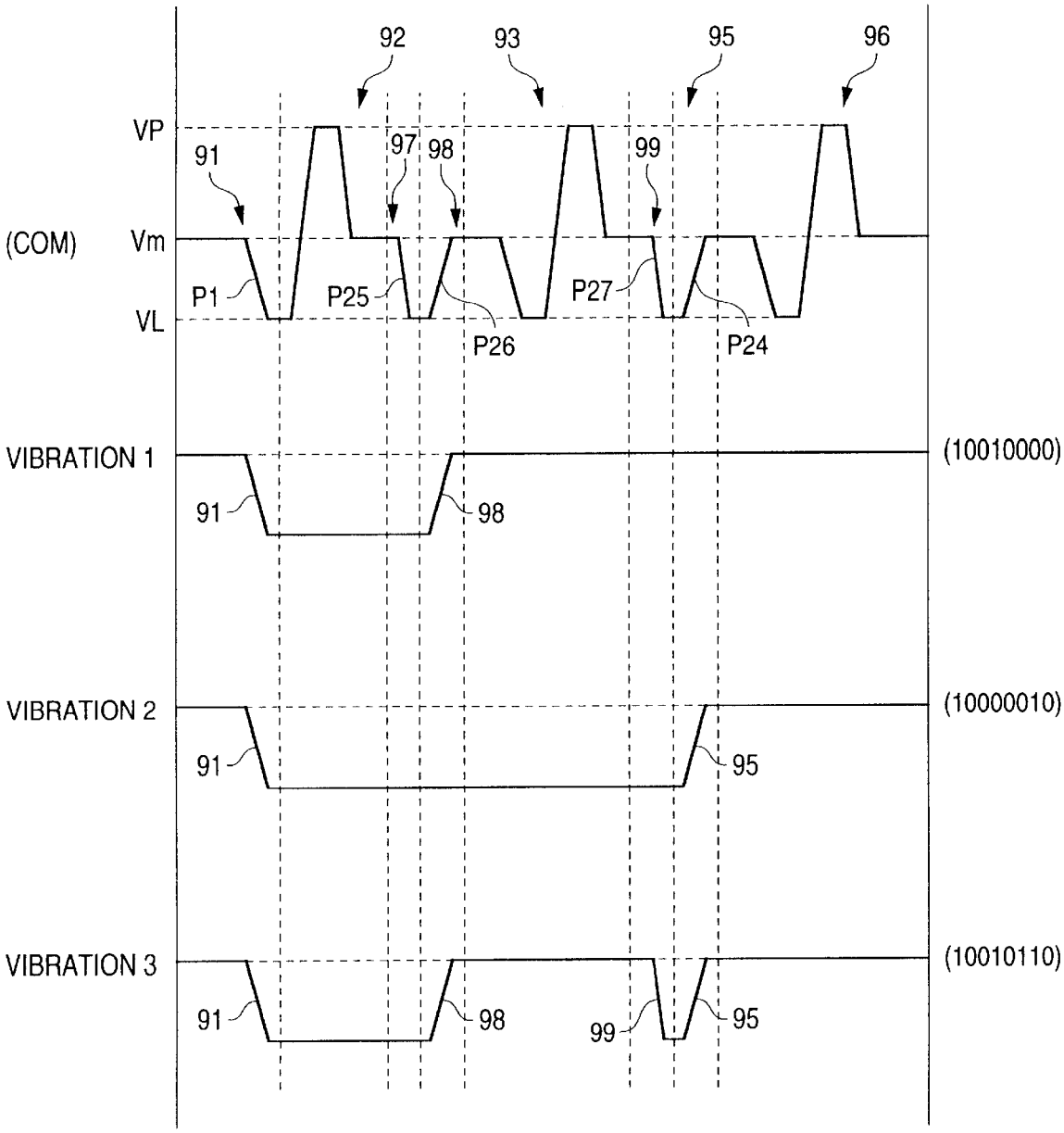
FIG. 9 is a chart to describe pulse signal selection patterns according to a third embodiment of the invention.

First, the third embodiment of the invention will be discussed. FIG. 9 is a chart to describe a drive signal generated by a drive signal generating unit 9 in the third embodiment of the invention. Other components of the third embodiment are identical with those of the first embodiment and therefore will not be discussed again.

As shown in FIG. 9, the drive signal generated by the drive signal generating unit 9 in the third embodiment is a signal provided by changing a part of the drive signal in the second embodiment. That is, the drive signal in the third embodiment differs from that in the second embodiment in that a seventh pulse 97 and an eighth pulse 98 are placed between a second pulse 92 and a third pulse 93 and that a ninth pulse 99 is placed instead of the fourth pulse 94.

The seventh pulse 97 is a connection waveform containing a connection element P25 for joining different potential levels of the termination potential of the second pulse 92 (Vm) and the start end potential of the eighth pulse 98 (VL). Since the seventh pulse 97 is not applied to a piezoelectric vibrator 39 either, a steep gradient is set.

The eighth pulse 98 is the other waveform element of vibration pulse divisions (fine contraction waveform) and has a similar function to that of a fifth pulse 95. The eighth pulse 98 contains a fine contraction element P26. The fine contraction element P26 is also constitutes the pressure increasing element of the invention and is an element for raising potential on a moderate gradient from lowest potential VL to intermediate potential Vm to such an extent that an ink drop is not ejected.

The ninth pulse 99 is one waveform element of vibration pulse divisions (fine expansion waveform) and contains a fine expansion element P27. The fine expansion element P27 constitutes the pressure reducing element of the invention and is an element for dropping potential on a moderate gradient from the intermediate potential Vm to lowest potential VL to such an extent that an ink drop is not ejected.

Therefore, the drive signal in the embodiment comprises an expansion element P1 of a first pulse 91 and the fine expansion element P27 of the ninth pulse 99 as a pressure reducing elements and a fine contraction element P24 of the five pulse 95 and the fine contraction element P26 of the eighth pulse 98 as a pressure increasing elements. This means that the drive signal contains a plurality of a pressure reducing elements and a plurality of a pressure increasing elements. A pulse supplier supplies the expansion element P1 and the fine expansion element P27 and the fine contraction element P24 and the fine contraction element P26 in appropriate combination to the piezoelectric vibrator 39 for changing the pressure variation pattern of liquid in a pressure chamber 35 at the vibration time. For example, the elements are supplied according to patterns shown as vibration 1, vibration 2, and vibration 3 in FIG. 9.

With the pattern of vibration 1, the first pulse 91 and the eighth pulse 98 are selectively applied to the piezoelectric vibrator 39, so that the vibration hold time (namely, the time between application termination of previously applied expansion element P1 and later applied fine contraction element P26) is set relatively short. With the pattern of vibration 2, the first pulse 91 and the fifth pulse 95 are selectively applied to the piezoelectric vibrator 39, so that the vibration hold time (namely, the time between application termination of expansion element P1 and fine contraction element P26) is set relatively long. With the pattern of vibration 3, the first pulse 91, the eighth pulse 98, the ninth pulse 99, and the fifth pulse 95 are selectively applied to the piezoelectric vibrator 39. In the pattern, the operation of expansion and contraction of the pressure chamber 35 is repeated twice.

An optimum vibration pattern for ink used is selected from among the vibration patterns. That is, any of print data of vibration 1 (10010000), print data of vibration 2 (10000010), or print data of vibration 3 (10010110) as the print data corresponding to gradation data (00) is set in a decoder unit 57 in response to the type of ink. For example, the pattern of vibration 1 is set for ink whose viscosity is relatively hard to rise, such as dye-family ink. The pattern of vibration 2 or 3 is set for ink whose viscosity is relatively easy to rise, such as pigment-family ink. Consequently, optimum vibration response to the ink properties can be carried out.

Figure 10:
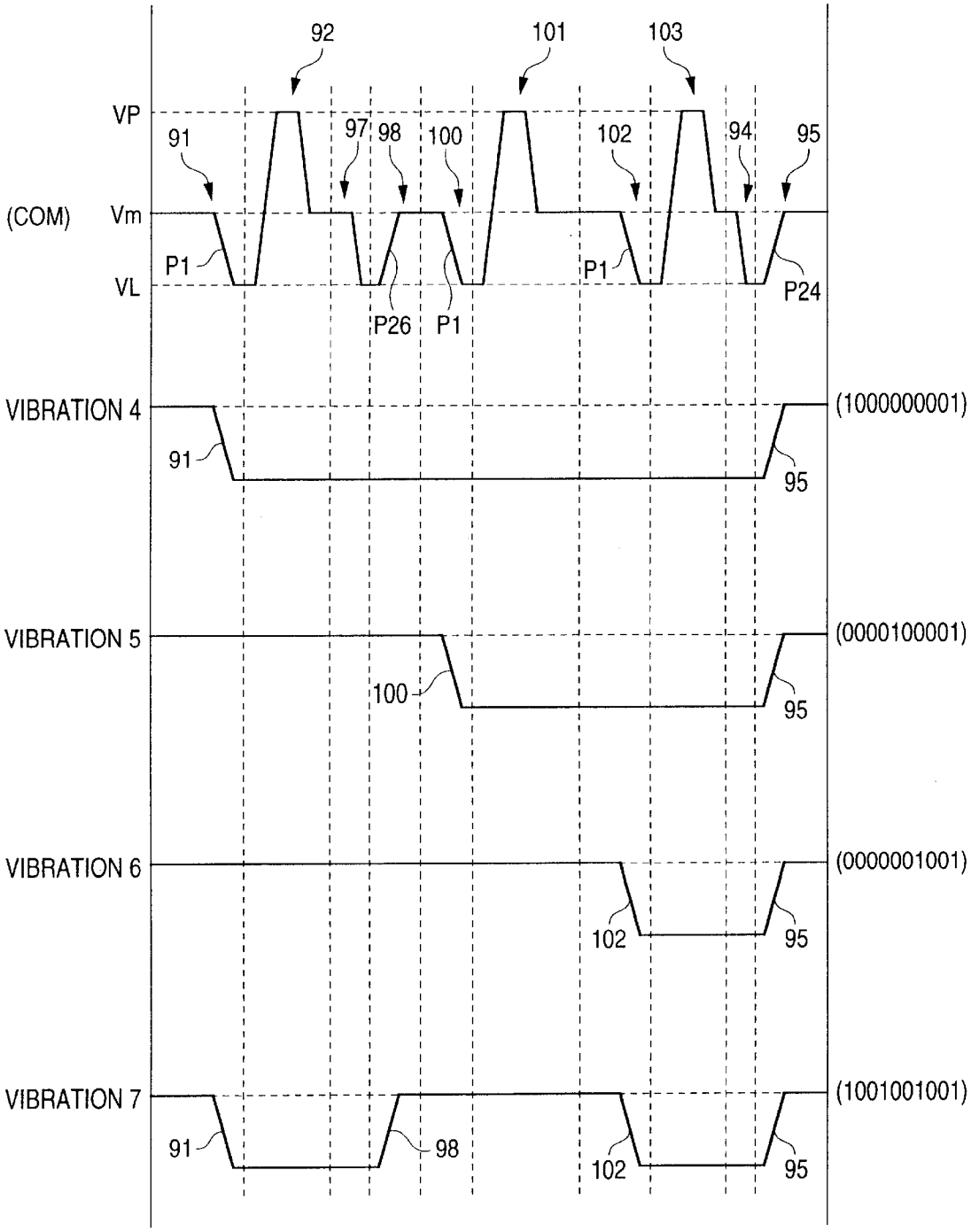
FIG. 10 is a chart to describe pulse signal selection patterns according to a fourth embodiment of the invention.

Next, the fourth embodiment of the invention will be discussed. FIG. 10 is a chart to describe a drive signal generated by a drive signal generating unit 9 in the fourth embodiment of the invention. The drive signal is a signal provided by modifying the drive signal in the second embodiment. That is, the third pulse 93 in the second embodiment is divided into two parts with regard to a time axis direction in an intermediate point of expansion hold element and the front portion is used as a tenth pulse 100 and the rear portion is used as an eleventh pulse 101. Likewise, the sixth pulse 96 in the second embodiment is divided into two parts with regard to a time axis direction in an intermediate point of expansion hold element and the front portion is used as a twelfth pulse 102 and the rear portion is used as a thirteenth pulse 103. Further, a seventh pulse 97 and an eighth pulse 98 are placed between a second pulse 92 and the tenth pulse 100 and a fourth pulse 94 and a fifth pulse 95 are placed behind the thirteenth pulse 103. In the drive signal, the tenth pulse 100 and the twelfth pulse 102 become each one waveform element of vibration pulse divisions.

The drive signal is also a drive signal containing a plurality of a pressure reducing elements and a plurality of a pressure increasing elements. That is, the drive signal comprises an expansion element P1 of a first pulse 91, an expansion element P1 of the tenth pulse 100, and an expansion element P1 of the twelfth pulse 102 as the pressure reducing elements and a fine contraction element P24 of the five pulse 95 and a fine contraction element P26 of the eighth pulse 98 as the pressure increasing elements. A pulse supplier supplies the expansion elements P1 and the fine expansion element P27 and the fine contraction element P24 and the fine contraction element P26 in appropriate combination to the piezoelectric vibrator 39 for changing the pressure variation pattern of liquid in a pressure chamber 35 at the vibration time. For example, the elements are supplied according to patterns shown as vibration 4, vibration 5, vibration 6, and vibration 7 in FIG. 10.

With the pattern of vibration 4, the first pulse 91 and the fifth pulse 95 are selectively applied to the piezoelectric vibrator 39, so that the vibration hold time (namely, the time between the termination of element P1 and the start end of fine contraction element P24) is set the longest. With the pattern of vibration 5, the tenth pulse 100 and the fifth pulse 95 are selectively applied to the piezoelectric vibrator 39, so that the vibration hold time is set to a medium duration. With the pattern of vibration 6, the twelfth pulse 102 and the fifth pulse 95 are selectively applied to the piezoelectric vibrator 39, so that the vibration hold time is set the shortest. Further, with the pattern of vibration 7, the first pulse 91, the eighth pulse 98, the twelfth pulse 102, and the fifth pulse 95 are selectively applied to the piezoelectric vibrator 39. In the pattern, the operation of expansion and contraction of the pressure chamber 35 is repeated twice.

Also in the embodiment, an optimum vibration pattern for ink used is selected from among the vibration patterns. That is, any of print data of vibration 4 (1000000001), print data of vibration 5 (0000100001), print data of vibration 6 (0000001001), or print data of vibration 7 (1001001001) as the print data corresponding to gradation data (00) is set in a decoder unit 57 in response to the type of ink. Consequently, optimum vibration response to the ink properties can be carried out.

In the third and fourth embodiments described above, the drive signal generating unit 9 generates the drive signal containing a plurality of pressure reducing elements and a plurality of pressure increasing elements, but the invention is not limited thereto. That is, a similar advantage is provided if at least either a plurality of pressure reducing elements or a plurality of pressure increasing elements are contained in the drive signal.

By the way, in the second, third and fourth embodiments described above, the pressure reducing element is formed using a part of ejection pulse signal; the pressure increasing element can also be formed using a part of ejection pulse signal. That is, each of the pressure reducing element and the pressure increasing element can be formed using a part of ejection pulse signal. Another embodiment with the fine compression as a part of ejection pulse signal will be discussed.

Figures 11A, 11B:
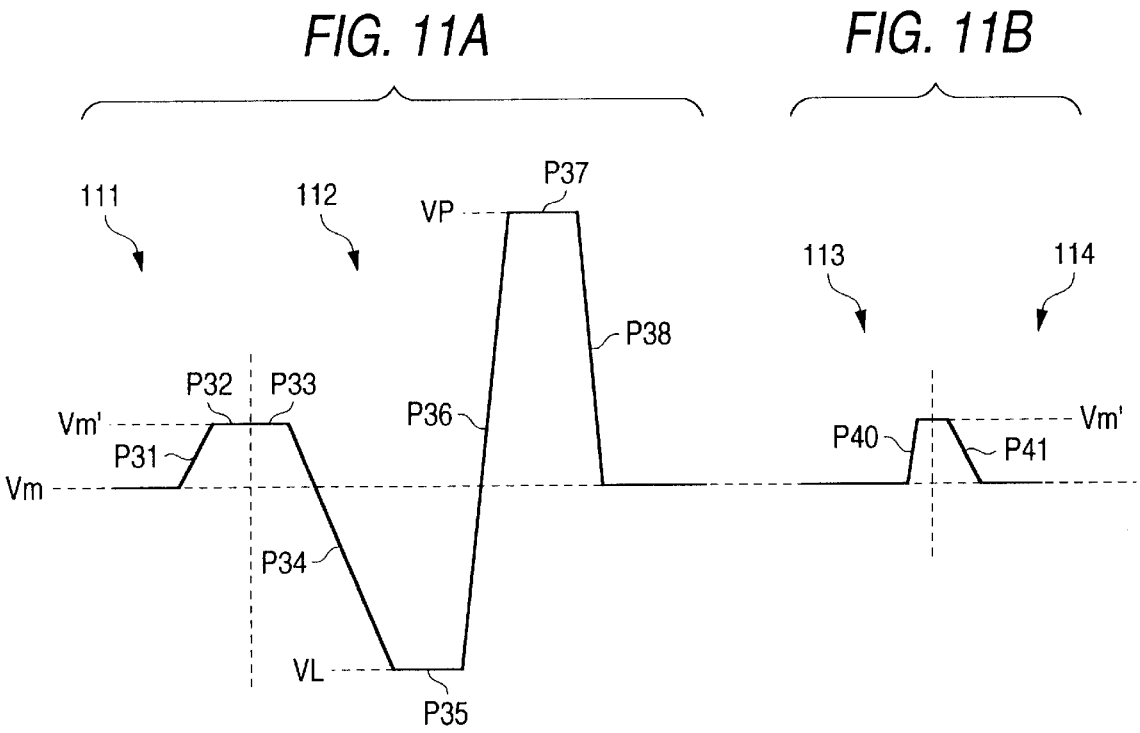
FIG. 11A is a chart to describe an ejection pulse signal in a pulse signal according to a fifth embodiment of the invention.
FIG. 11B is a chart to describe a connection waveform and a fine expansion waveform in the pulse signal according to the fifth embodiment of the present invention.

FIG. 11A is shows an ejection pulse signal contained in a drive signal sequence generated by a drive signal generating unit 9 in a fifth embodiment of the invention. FIG. 11B shows a connection waveform and a fine expansion waveform contained in the drive signal.

The ejection pulse signal consists of a first pulse 111 and a second pulse 112. The first pulse 111 is made up of an auxiliary contraction element P31 for raising potential on a constant gradient from intermediate potential Vm to second intermediate potential Vm' to such an extent that an ink drop is not ejected, and a first auxiliary contraction hold element P32 for holding the second intermediate potential Vm' for a predetermined time. Vm' is set slightly higher than the intermediate potential Vm. The second pulse 112 is made up of a second auxiliary contraction hold element P33 for holding the second intermediate potential Vm' for a predetermined time, an expansion element P34 for dropping potential on a constant gradient from the second intermediate potential Vm' to lowest potential VL to such an extent that an ink drop is not ejected, an expansion hold element P35 for holding the lowest potential VL for a predetermined time, a ejection element P36 for raising potential on a steep gradient from the lowest potential VL to highest potential VP, a contraction hold element P37 for holding the highest potential VP for a predetermined time, and a damping element P38 for dropping potential from the highest potential VP to the intermediate potential Vm.

The connection waveform is provided by a third pulse 113. The third pulse 113 contains a connection element P40 for raising potential on a steep gradient from the intermediate potential Vm to the second intermediate potential Vm'.

The fine expansion waveform is provided as a fourth pulse 114. The fourth pulse 114 contains a fine expansion element P41, which also constitutes the pressure reducing element of the invention for dropping potential on a moderate gradient from the second intermediate potential Vm' to the intermediate potential Vm to such an extent that an ink drop is not ejected.

In the embodiment, the first pulse 111 forming a part of the ejection pulse signal is used as the fine compression waveform and the fourth pulse 114 is used as the fine decompression waveform. That is, for gradation value 1 indicating no dot, the first pulse 111 and the fourth pulse 114 are applied to a piezoelectric vibrator 39, whereby a meniscus is finely vibrated and ink in the vicinity of a nozzle orifice 29 is agitated.

In the embodiments described above, the fine decompression waveform and the fine compression waveform are used in combination within one unit printing period T, but the invention is not limited thereto. For example, the elements can also be used in combination across unit printing periods.

As many apparently widely different embodiments of the invention may be made without departing from the spirit and scope thereof, it is to be understood that the invention is not limited to the specific embodiments thereof. For example, the control unit 6 may be used as a computer for controlling the drive signal generating unit 9. In this case, a printer is provided with a card slot 200 (FIG. 1) functioning as a recording medium reader, and the card slot and the control unit 6 are electrically connected. A memory card is inserted into the card slot, whereby it is made possible for the control unit 6 to read waveform pattern information recorded on the memory card. For example, selection information, etc., of data of different types of voltage variation amounts to be stored in the waveform memory 63, address data corresponding to the voltage variation amount data, and address data updated every update period is recorded on the memory card as the waveform pattern information.

Based on the read waveform pattern information, the control unit 6 controls the drive signal generating unit 9 to generate a drive signal sequence containing fine expansion waveform, fine contraction waveform, ejection pulse signal, etc., as covered in the description of the embodiments.

The waveform pattern information stored on the memory card is not limited to one type and may be of more than one type. In this case, preferably if information on the type of ink to be jetted (for example, dye ink or pigment ink) is recorded in association with the waveform pattern information, an optimum vibration pattern can be selected in response to easiness to increase the viscosity of ink to be jetted.

The recording medium for recording the waveform pattern information is not limited to the memory card and may be any if it can record information readable by a computer. For example, it may be a floppy disk, a hard disk, or a magneto-optic disk.

The computer for controlling the drive signal generating unit 9 is not limited to the control unit 6 and may be a host computer connected directly to a printer or a plurality of network computers connected via a network.

In the embodiments, conversion from gradation data to print data is executed by the decoder unit 57, but a controller comprising a CPU may be used in place of the decoder.

The piezoelectric vibrator 39 in so-called deflection vibration mode is used as the pressure generating element, but instead, a piezoelectric vibrator in vertical vibration mode may be used. The piezoelectric vibrator in vertical vibration mode is a vibrator contracted in a direction of expanding the pressure chamber 35 on charge and extended in a direction of contracting the pressure chamber 35 on discharge.

The pressure generating element for changing the volume of the pressure chamber 35 is not limited to the piezoelectric vibrator 39. For example, a magnetostrictor may be used as the pressure generating element.

Figure 12:
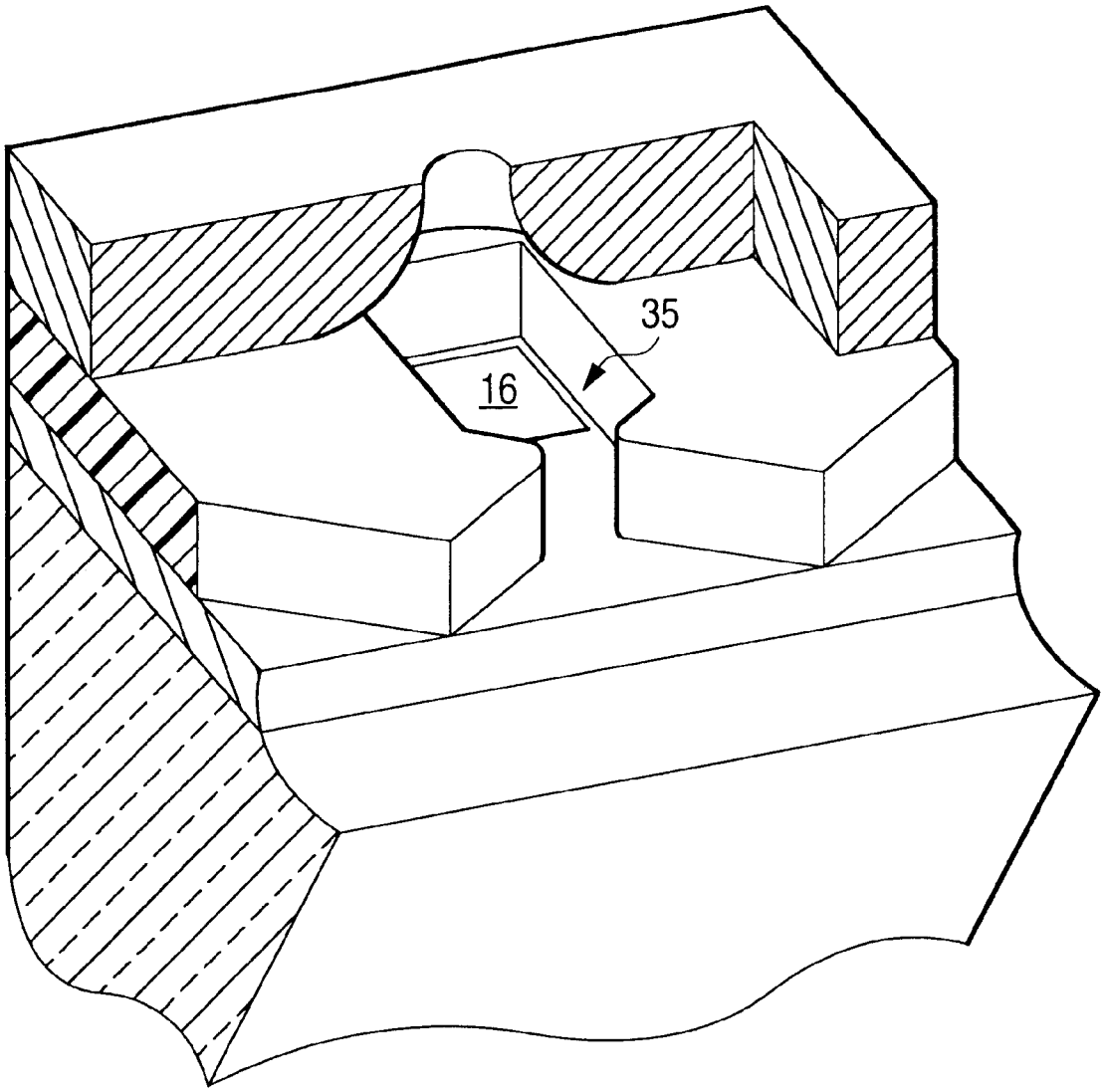
FIG. 12 is a perspective view showing a heating element used as a pressure generating element.

As shown in FIG. 12, a heating element 16 such as a heater may be used as the pressure generating element and bubbles expanded or contracted by heat generated by the heating element may cause pressure variation to occur in liquid in the pressure chamber 35.

Further, the invention can also be applied to an apparatus for jetting liquid of glue, manicure, etc., through a nozzle orifice.

What is claimed is:

1. A liquid jetting apparatus comprising:

a nozzle orifice from which a liquid drop is ejected;

a pressure chamber communicated with the nozzle orifice;

a pressure generating element for generating pressure change in liquid in the pressure chamber;

a drive signal generator for generating a drive signal including:

a vibration pulse signal configured to vibrate a meniscus of the liquid in the nozzle orifice, which is separated into at least one pressure reducing element configured to reduce pressure of the liquid in the pressure chamber to such an extent that a liquid drop is not ejected from the nozzle orifice and at least one pressure increasing element configured to increase pressure of the liquid in the pressure chamber to such an extent that a liquid drop is not ejected from the nozzle orifice; and a plurality of ejection pulse signals each including an ejection element configured to eject liquid drop from the nozzle orifice, at least one of the ejection elements being placed between the pressure reducing element and the pressure increasing element; and a pulse supplier for selectively supplying at least one of the pressure reducing element, the pressure increasing element and the ejection element from the drive signal to the pressure generating element so as to generate pressure change in liquid in the pressure chamber in accordance with the configuration of the respective elements, wherein the pressure reducing element and the pressure increasing element are never selected with the ejection pulse signal when the ink drop is ejected.

2. The liquid jetting apparatus as set forth in claim 1, wherein at least one of the pressure reducing element and the pressure increasing element is placed between the adjacent ejection pulse signals.

3. The liquid jetting apparatus as set forth in claim 1, wherein at least one of the pressure reducing element and the pressure increasing element constitutes a part of one of the ejection pulse signal.

4. The liquid jetting apparatus as set forth in claim 1, wherein the drive signal includes at least one of a plurality of pressure reducing elements and a plurality of pressure increasing elements, and wherein the pulse supplier selects on combination set of the pressure reducing element and the pressure increasing element form the plural elements to change a pattern of the pressure change in the liquid.

5. The liquid jetting apparatus as set forth in claim 4, wherein the combination set is so determined as to select a time period between the pressure reducing element and the pressure increasing element in accordance with the kind of liquid to be ejected.

6. The liquid jetting apparatus as set forth in claim 1, wherein the plural ejection pulse signals have identical waveforms with each other.

7. The liquid jetting apparatus as set forth in claim 6, wherein the plural ejection pulse signals are arranged in the drive signal with a constant interval.

8. The liquid jetting apparatus as set forth in claim 6, wherein the pulse supplier selects the number of ejection pulse signals to be supplied in accordance with a gradation value of an image to be recorded by the apparatus.

9. The liquid jetting apparatus as set forth in claim 8, wherein the drive signal includes at least three ejection pulse signals in series; and wherein the pulse supplier supplies an ejection pulse signal other than ejection pulse signals placed at both ends of the pulse signal series to eject a liquid drop to record a relatively small dot.

10. The liquid jetting apparatus as set forth in claim 8, wherein the drive signal is configured so as to include three ejection pulse signals in series within a unit printing period;

wherein the pulse supplier supplies the second ejection pulse signal to eject a main liquid drop to record a relatively small dot;

wherein the pulse supplier supplies the first and third ejection pulse signals to eject two main liquid drops to record a relatively medium dot; and wherein the pulse supplier supplies all the ejection pulse signals to eject three main liquid drops to record a relatively large dot.

11. The liquid jetting apparatus as set forth in claim 1, wherein the pressure generating element is a piezoelectric element for varying the volume of the pressure chamber to generate pressure change in the liquid therein.

12. The liquid jetting apparatus as set forth in claim 1, wherein the pressure generating element is a heating element for generating heat to vary volumes of air bubbles in the liquid in the pressure chamber to generate pressure change in the liquid therein.

13. A computer-readable recording medium in which waveform pattern data for the drive signal generator as set forth in claim 1 to generate the drive signal having a waveform corresponding to the waveform pattern data is recorded.

14. The recording medium as set forth in claim 13, wherein information related to the kind of liquid to be ejected is recorded in association with the waveform pattern data.

15. A liquid jetting apparatus comprising:

a nozzle orifice from which a liquid drop is ejected;

a pressure chamber communicated with the nozzle orifice;

a pressure generating element for generating pressure change in liquid in the pressure chamber;

a drive signal generator for generating a drive signal including:

a vibration pulse signal configured to vibrate a meniscus of the liquid in the nozzle orifice, which is separated into at least one pressure reducing element configured to reduce pressure of the liquid in the pressure chamber to such an extent that a liquid drop is not ejected from the nozzle orifice and at least one pressure increasing element configured to increase pressure of the liquid in the pressure chamber to such an extent that a liquid drop is not ejected from the nozzle orifice; and a plurality of ejection pulse signals each including an ejection element configured to eject liquid drop from the nozzle orifice, at least one of the ejection elements being placed between the pressure reducing element and the pressure increasing element;

a pulse supplier for selectively supplying at least one of the pressure reducing element, the pressure increasing element and the ejection element from the drive signal to the pressure generating element so as to generate pressure change in liquid in the pressure chamber in accordance with the configuration of the respective elements, wherein the pressure reducing element and the pressure increasing element are never selected with the ejection pulse signal when the ink drop is ejected, and wherein different potential levels of the ejection pulse signal and at least one of the pressure reducing element and the pressure increasing element are connected by a connection element which is not to be applied to the pressure generating element.

16. A method of driving a liquid jetting apparatus for jetting a liquid drop from a nozzle orifice by a pressure generating element for generating pressure change in liquid in a pressure chamber communicated with the nozzle orifice, the method comprising the steps of:

generating a drive signal including:

at least one pressure reducing element configured to reduce pressure of liquid in the pressure chamber to such an extent that a liquid drop is not ejected from the nozzle orifice;

at least one pressure increasing element configured to increase pressure of liquid in the pressure chamber to such an extent that a liquid drop is not ejected from the nozzle orifice; and at least one ejection configured to eject a liquid drop from the nozzle orifice and placed between the pressure reducing element and the pressure increasing element, and selectively supplying the pressure reducing element and the pressure increasing element from the drive signal to the pressure generating element so as to slightly vibrate a meniscus of the liquid in the nozzle orifice, wherein the pressure reducing element and the pressure increasing element are never selected with the ejection pulse signal when the ink drop is ejected.

17. The driving method as set forth in claim 16, wherein the drive signal is configured to include a plurality of ejection pulse signals, each containing the ejection element, within a unit printing period; and wherein at least one of the pressure reducing element and the pressure increasing element is placed between the adjacent ejection pulse signals.

18. The driving method as set forth in claim 16, wherein at least one of the pressure reducing element and the pressure increasing element constitutes a part of one of the ejection pulse signal.

* * * * *